US006295480B1

(12) United States Patent
Kayanaka et al.

(10) Patent No.: US 6,295,480 B1
(45) Date of Patent: Sep. 25, 2001

(54) APPLICABILITY DETERMINATION DEVICE FOR QUILT DESIGN AND MEMORY MEDIUM STORING A CONTROLLING PROGRAM THEREOF

(75) Inventors: Yoshihisa Kayanaka, Aichi-ken; Ryohei Komiya, Nagoya; Takeshi Kawaguchi; Toshihiko Ikeda, both of Kounan; Michiyo Amano, Gifu; Yumiko Takeda; Satoru Makino, both of Nagoya, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/514,585

(22) Filed: Feb. 28, 2000

(30) Foreign Application Priority Data

Feb. 26, 2000 (JP) ..... 11-051166

(51) Int. Cl.[7] ..... G06F 19/00; D05B 11/00
(52) U.S. Cl. ..... 700/133; 700/138; 112/117
(58) Field of Search ..... 700/131, 132, 700/133, 136, 137, 138; 112/117, 118, 119, 102.5, 475.08

(56) References Cited

U.S. PATENT DOCUMENTS 5,095,835 * 3/1992 Jernigan et al. ..... 112/119 X
5,826,526 * 10/1998 Tomita ..... 700/138 X
6,026,756 * 2/2000 Frazer et al. ..... 112/118

* cited by examiner

*Primary Examiner*—Peter Nerbun
(74) *Attorney, Agent, or Firm*—Oliff & Berridge, P.L.C.

(57) ABSTRACT

A CPU selects a line segment, whose both endpoints constructing a part of a quilt design are on a periphery, and then selects a line segment, which separates a piece from the quilt design on a piece-by-piece basis so that the separated piece will not have a line segment to become a separation line, from the selected line segments, after separation. When the line segment can be selected, a piece is separated from the quilt design at the selected line segment on a piece-by-piece basis. Then, the CPU determines that the quilt design, whose one piece has been separated, is the object to be determined, and separates pieces from the quilt design on a piece-by-piece basis. When all line segments are used for the separation, an applicability determination flag is set, because all pieces in the quilt design are separated into pieces on the piece-by-piece basis.

31 Claims, 32 Drawing Sheets

Fig.4

ENDPOINT INFORMATION LIST

55c

| | X COORDINATE | Y COORDINATE | FLAG ON PERIPHERY |
|---|---|---|---|
| A | xa | ya | 1 |
| B | xb | yb | 1 |
| C | xc | yc | 1 |
| D | xd | yd | 1 |
| E | xe | ye | 1 |
| F | xf | yf | 1 |
| G | xg | yg | 1 |
| H | xh | yh | 1 |
| J | xj | yj | 0 |

Fig.5

MATRIX OF ENDPOINT CONNECTION

55d

| | A | B | C | D | E | F | G | H | J |
|---|---|---|---|---|---|---|---|---|---|
| A | | ○ | × | × | × | × | × | ○ | ○ |
| B | ○ | | ○ | × | × | ○ | × | × | × |
| C | × | ○ | | ○ | ○ | × | × | × | × |
| D | × | × | ○ | | ○ | × | × | × | × |
| E | × | × | ○ | ○ | | ○ | × | × | × |
| F | × | ○ | × | × | ○ | | ○ | × | × |
| G | × | × | × | × | × | ○ | | ○ | ○ |
| H | ○ | × | × | × | × | × | ○ | | ○ |
| J | ○ | × | × | × | × | × | ○ | ○ | |

Fig.6A

55e

Lp={(A, J), (B, F), (C, E), (G, J), (H, J)}
Ls={(B, F), (C, E)}
Li {(A, J), (G, J), (H, J)}

Fig.6B

55e

Ls={(B, F), (C, E)}
Lm={(A, J, G, )}
Ln={(H, J)}

Fig.8A

55e

| | |
|---|---|
| 1 | (C, E) |
| 2 | (B, F) |
| 3 | (A, J, G, ) |
| 4 | (H, J) |

Fig.8B

55f

| | |
|---|---|
| 1 | (H, J) |
| 2 | (A, J, G, ) |
| 3 | (C, E) |
| 4 | (B, F) |

Fig.9A

CUTTING DATA LIST

55g

| DESIGN | CUTTING TYPE | DEMARCATION LINE | PIECE/BLOCK TO BE CUT |
|---|---|---|---|
| NORTH WIND | SEPARATION | BH | P1b |
| | SEPARATION | DF | P2b |
| | DIVISION | CG | Q, R |
| BLOCK Q | SEPARATION | HL | Q1b |
| | SEPARATION | IL | Q2b |
| | SEPARATION | IJ | Q3b |
| | SEPARATION | BJ | Q4B |
| BLOCK R | SEPARATION | LF | R1b |
| | SEPARATION | LK | R2b |
| | SEPARATION | JK | R3b |
| | SEPARATION | JD | R4b |

Fig.9B

AFTER ARRANGING DIVIDING INFORMATION

55g

| DESIGN | CUTTING TYPE | DEMARCATION LINE | PIECE/BLOCK TO BE SEPARATED |
|---|---|---|---|
| NORTH WIND | DIVISION | CG | Q, R |
| BLOCK Q | SEPARATION | BH | P1b |
| | SEPARATION | HL | Q1b |
| | SEPARATION | IL | Q2b |
| | SEPARATION | IJ | Q3b |
| | SEPARATION | BJ | Q4B |
| BLOCK R | SEPARATION | DF | P2b |
| | SEPARATION | LF | R1b |
| | SEPARATION | LK | R2b |
| | SEPARATION | JK | R3b |
| | SEPARATION | JD | R4b |

APPLICABILITY DETERMINATION DEVICE FOR QUILT DESIGN AND MEMORY MEDIUM STORING A CONTROLLING PROGRAM THEREOF

BACKGROUND OF THE INVENTION

1. Field of the Invention

The present invention relates to an applicability determination device, which is capable of automatically determining whether a design of a quilt to be made can be pieced together using a suggested piecing method, for quilt design, and a memory medium storing a computer program thereof which allows the applicability determination device to perform such a function.

2. Description of the Related Art

A conventional method for making a quilt is described below. First, a desirable quilt is designed. Next, patches called pieces, which are suitable for structuring a quilt design, are prepared. Then, the pieces are pieced together one by one using a sewing machine.

Recently, a method known as a paper piecing (also known as a paper foundation piecing) has become widespread. In accordance with this method, the pieces are stitched on a foundation. A quilt design is printed on the foundation with numbers showing a piecing order.

The advantages of this method are that chunks of fabric can be used, and it is not necessary to mark on a fabric or to cut the fabric to a suitable size for a foundation in advance. Therefore, a desirable quilt can be made extremely easily, and can be beautifully made even though the pieces are small, using the method described above.

However, the paper piecing is not applicable to all quilt designs because the method repeats stitching on only one side of a piece on a foundation with straight stitches using a sewing machine.

Quilt designs to which the paper piecing is not applicable will be described with reference to FIGS. 31A through 32D. FIG. 31A illustrates a quilt design called a "fish"; FIG. 31B illustrates a quilt design called "boxes"; FIG. 31C illustrates a quilt design called a "NorthWind"; and FIG. 31D illustrates a modified quilt design of the quilt design shown in FIG. 31B.

FIGS. 32A through 32D illustrate an example of a quilt design to which the paper piecing is not applicable.

In each figure, the letters and numbers show the pieces and the piecing order, respectively.

The quilt design "fish" shown in FIG. 31A can be made by piecing the pieces together, following the piecing order shown by numbers.

However, the quilt design "boxes" shown in 31B, as shown in FIGS. 32A through 32D, is not applicable to the paper piecing because two sides of a piece T4 have to be stitched with straight stitches, though a piece T1 and a piece T2 can be stitched together along a seam line M1, and also a piece T3 can be stitched along a seam line M2, on a foundation 70.

Further, triangles gathered on both sides of a line L1 in the quilt design "NorthWind" shown in FIG. 31C cannot be pieced together using the paper piecing. However, it becomes possible to make the quilt design "NorthWind" when a block Q and a block R divided at the line L1 are first made each by piecing each of the pieces together using the paper piecing, and then the block Q and the block R are joined.

As described above, quilt designs exist to which the paper piecing is not applicable. Further, a situation exists where a quilt design cannot be made unless the paper piecing and the joint of blocks are combined.

However, a problem arises that only the person who has the skill of determination can determine the quilt designs and whether the quilt design is applicable to the paper piecing or whether it becomes possible to make a quilt if the paper piecing and the joint of blocks are combined. At present, the specific designers having such a skill design the quilts for paper piecing. General quilters use the existing quilt designs, and a perception exists that it is difficult for one to design one's own quilts by oneself.

Further, the situation often arises where a person who has designed quilts finds it difficult to judge the complicated design.

SUMMARY OF THE INVENTION

It is an object of the invention to provide an applicability determination device, which is capable of automatically determining whether a design of a quilt to be made is applicable to a predetermined piecing method, for quilt design, and a memory medium storing a computer program thereof which allows the applicability determination device to perform such a function.

In order to achieve the above and other objects, an applicability determination device according to the invention comprises an analyzer that analyzes a design based on a quilt data showing a quilt design that includes a plurality of pieces, and a determiner that determines whether the design is applicable to a predetermined piecing method for making a quilt, based on the analytical results.

That is, the quilt design that includes a plurality of pieces is analyzed by the analyzer, and the determiner automatically determines whether the design is applicable to the predetermined piecing method for making a quilt based on the analytical results.

Therefore, it can be determined whether the quilt design is applicable to the predetermined piecing method for making a quilt, regardless of an individual's experience or inexperience in quilt making.

An applicability determination according to the invention can be performed by allowing a computer to execute an applicability determination program, which is stored in a memory medium, including an analyzing program that analyzes the design based on a quilt data showing a quilt design that includes a plurality of pieces and a determination program that determines whether the design is applicable to the predetermined piecing method for making a quilt, based on the analytical results.

That is, for example, as described later in embodiments of the invention, the analysis and the determination can be performed by installing the applicability determination program, which is stored in a CD-ROM or a floppy disk (FD) that is a memory medium, in the computer, or driving the memory medium by the computer when using the computer.

The analysis and the determination can be also performed by storing the applicability determination program on a memory medium provided in the computer or a controller like a computer before the computer or controller is shipped.

In one aspect of the invention, the analyzer can be structured so as to analyze a property of a demarcation line separating adjacent pieces, and the determiner can be structured so as to comprise a piece separator separating a piece from the design at the demarcation line that is a separation line on a piece-by-piece basis, and a piece separation determiner that determines whether all pieces can be separated by repeating the separation by the piece separator, wherein the determiner can be structured so as to determine whether the design is applicable to the piecing method that makes a quilt by stitching pieces on a piece-by-piece basis.

In such structures, the piece separator provided in the determiner separates a piece from the design at the demarcation line that is the separation line on a piece-by-piece basis based on the property of the demarcation line analyzed by the analyzer. The piece separation determiner automatically determines whether all pieces are separated into pieces, by repeating the separation by the piece separator. In other words, the piece separation determiner determines whether a quilt having the design described above can be made by repeating piecing pieces on a piece-by-piece basis.

The determiner automatically determines whether the design is applicable to the piecing method for making a quilt by piecing pieces on a piece-by-piece basis.

Therefore, it can be determined whether the design is applicable to such piecing method regardless of an individual's experience or inexperience in determining whether the design is appropriate to the quilt design made by repeating piecing pieces on a piece-by-piece basis.

In another aspect of the invention, the analyzing program can be structured so as to analyze the property of demarcation line separating adjacent pieces, and the determination program can be structured so as to comprise a piece separation program that separates a piece from the design at the demarcation line as the separation line by a piece-by-piece basis, and the piece separation determination program determines whether all pieces can be separated by repeating the piece separation program, wherein the determination program can be structured so as to determine whether the design is applicable to a piecing method that makes a quilt by stitching pieces by a piece-by-piece basis.

In another aspect of the present invention, the applicability determination device can further comprise a separation line data memory that stores separation line data showing a separation line to be used when the piece separator separates a piece, and a piecing order data generator that generates data on a piecing order of each piece, based on the piecing order, which is an inverse of a recording order of the separation line data stored in the separation line data memory, and the separation line data corresponding to the piecing order.

That is, the separation data memory stores the separation data showing the separation lines used when the piece separator separates a piece, in order. The piecing order data generator generates data on the piecing order of each piece based on the piecing order that is the inverse of the separation line data stored in the separation line data memory and the separation data corresponding to the piecing order.

Therefore, as each piece is stitched based on the generated data on the piecing order, the quilt having the design can be made, so that the quilt can be easily made regardless of an individual's experience or inexperience in making a quilt.

In other aspect of the invention, the determiner can comprise a divider that divides the design into two blocks that includes a plurality of the pieces at a demarcation line as the division line bases on the property of the demarcation line analyzed by the analyzer. The piece separation determiner determines whether all pieces are separated by combining the division performed by the divider and the separation performed by the piece separator, and then determines whether the design is applicable to the piecing method for making the quilt by a combination of piecing pieces and the joining the blocks.

That is, the divider provided in the determiner divides the design into two blocks that include a plurality of pieces at a demarcation line regarded as the division line, based on the property of the demarcation line analyzed by the analyzer. The piece separation determiner determines whether all pieces are separated by combination of the division performed by the divider and the separation performed by the piece separator.

The determiner determines whether the design is applicable to the piecing method for making the quilt by the combination of piecing pieces on a piece-by-piece basis and the joining of the blocks, based on the determination results of the piece separation determiner.

Therefore, it can be determined whether the design is applicable to such method regardless of an individual's experience or inexperience in using the method for making the quilt by the combination of the piecing pieces on a piece-by-piece basis and the joining of the blocks.

In another aspect of the invention, the applicability determination device can further comprise a cutting data memory that stores the separation line data showing the separation line to be used when the piece divider separates a piece and the division line data showing the division line to be used when the divider divides the design into two blocks, in order, and a piecing order data generator that generates data on the piecing order of each piece based on the piecing order that is an inverse of the recording order of the separation data and the division data stored in the cutting data and the separation data and the division data corresponding to the piecing order.

That is, the cutting data memory stores the separation line data showing the separation line to be used when the piece divider separates a piece and the division line data showing the division line to be used when the divider divides the design into two blocks, in order, and a piecing order data generator generates data on the piecing order of each piece based on the piecing order that is an inverse of the recording order of the separation data and the division data stored in the cutting data and the separation data and the division data corresponding to the piecing order.

Therefore, as each piece and block are stitched based on the data on the generated piecing order, the quilt having the design can be made, so that the quilt can be easily made regardless of an individual's experience or inexperience in the piecing method that piecing of the pieces on a piece-by-piece basis and joining of the blocks are combined.

In another aspect of the invention, the piecing order data generator can be so structured as to generate data on the piecing order of each piece by associating the piecing order that is the inverse of the separation stored in the cutting data memory with the separation line data and the division line data corresponding the piecing order under a predetermined rule.

That is, a situation exists where a plurality of piecing order can be found based on the data stored in the cutting data memory. In such a case, by setting the predetermined rule to a desirable rule in advance, the data on the piecing order following the predetermined rule can be generated.

Therefore, if each piece and block are stitched based on the data on the generated piecing order, stitching following the predetermined rule can be performed.

In another aspect of the invention, the predetermined rule can be to set a number of joint of the blocks that include a plurality of pieces to be the lowest number.

Therefore, if each piece and the blocks are stitched based on the data on the generated piecing order, the joint of the blocks that include a plurality of pieces can be the lowest number.

For example, when the predetermined piecing method is the paper piecing that pieces are stitched on a paper corresponding to the design, it is preferable that the number of joint of the blocks is lower because the paper piecing features that the pieces are pieced together on a piece-by-piece basis.

That is, the predetermined rule is preferable to the paper piecing.

In other aspect of the invention, the predetermined rule can be that the piecing order of the joint of the blocks that include a plurality of pieces is postponed to the piecing order of piecing one piece, as far as possible.

Therefore, if each piece and block is stitched based on the data on the generated piecing order, the piecing order of the joint of the blocks that include a plurality of pieces can be postponed to the piecing order of piecing one piece, as far as possible.

For example, when the predetermined piecing method is the paper piecing described above, it is easy to position seams, and the seams of the blocks can be neatly stitched when blocks are made by piecing the pieces on a piece-by-piece basis and then the blocks are joined together. As described above, it is preferable that the piecing order of joining the blocks that include a plurality of pieces is postponed to the piecing order of piecing one piece, as far as possible.

In another aspect of the invention, the determiner can be so structured as to cut the design in a plurality of cutting steps using the separator and the divider. The cutting data memory can be so structured as to store the separation line data showing the separation line to be used when the piece separator achieves the piece separation and the division line data showing the division lines to be used when the divider achieves the division into two blocks, in order every cutting step. The piecing order generator can be so structured as to seek data on the piecing order of each piece every cutting step, based on the piecing order that is the inverse of recording order of the separation line data and the division line data stored in the cutting data memory and the separation data and the division data corresponding to the piecing order, to select the data meeting a predetermined criteria from the data on the obtained piecing order, and to generate data as the selected piecing order data.

That is, depending on the design, a situation exists where a plurality of combinations of the separation on a piece-by-piece basis and the division into two blocks.

Therefore, in such a case, data of the case, where a design is cut by a plurality of combinations, is stored in the cutting data memory, and the piecing order data generator generates data satisfying a predetermined condition from the stored cutting data as data on the piecing order.

Therefore, when there are a plurality of combinations of the separation on a piece-by-piece basis and the division into two blocks, the data satisfying the predetermined criteria from the stored cutting data can be generated as the data on the piecing order. Thus, if each piece and block is stitched based on the generated piecing order, stitching satisfying the predetermined criteria can be performed.

In another aspect of the invention, the predetermined rule can be to set a number of joint of the blocks that include a plurality of pieces to be the lowest number.

Therefore, if each piece and the blocks are stitched based on the data on the generated piecing order, the joint of the blocks that include a plurality of pieces can be the lowest number.

For example, when the predetermined piecing method is the paper piecing that pieces are stitched on a paper corresponding to the design, it is preferable that the number of joint of the blocks is lower because the paper piecing features that the pieces are pieced together on a piece-by-piece basis.

That is, the predetermined rule is preferable to the paper piecing.

In another aspect of the invention, the predetermined rule can be that the piecing order of the joint of the blocks that include a plurality of pieces is postponed to the piecing order of piecing one piece, as far as possible.

Therefore, if each piece and block is stitched based on the data on the generated piecing order, the piecing order of the joint of the blocks that include a plurality of pieces can be postponed to the piecing order of piecing one piece, as far as possible.

For example, when the predetermined piecing method is the paper piecing described above, it is easy to position seams, and the seams of the blocks can be neatly stitched when blocks are made by piecing the pieces on a piece-by-piece basis and then the blocks are joined together. As described above, it is preferable that the piecing order of joining the blocks that include a plurality of pieces is postponed to the piecing order of piecing one piece, as far as possible.

In another aspect of the invention, the divider can be so structured as to divide the design into two blocks when the piece separation determiner determines that all pieces cannot be separated into pieces by the piece separator on a piece-by-piece basis.

That is, the division into two blocks is not included from the very beginning, and it is performed when the design is first determined that all pieces are not separated by the separation on a piece-by-piece basis.

Therefore, the determination as to whether the quilt design can be made using the piecing method, such as the paper piecing described above, for making the quilt by repeating piecing the pieces on a piece-by-piece basis can be performed prior to the determination of the division.

In another aspect of the invention, the piece separation determiner can be so structured as to determine that the design is not applicable to the piecing method for making a quilt by the combination of stitching a piece and joining two blocks when the number of divisions performed by the divider exceeds a predetermined number.

That is, for the piecing method that a quilt is made by repeating piecing pieces on a piece-by-piece basis, it is preferable that the number of divisions is lower, so that the design is determined as being not applicable to the piecing method when the number of divisions exceeds the predetermined number.

Therefore, the determination described above can be automatically performed regardless of an individual's experience or inexperience in determining the design which is not applicable to the piecing method when how many times of divisions exits.

In another aspect of the invention, the applicability determination device can further comprise a division number setting changer changing a setting of the predetermined number of divisions.

That is, differences exist among individuals as to the determination of the preferable number of times of divisions to the piecing method. However, the predetermined setting number of divisions can be changed, so that the number of divisions can be set to a desirable number according to the individuals.

In another aspect of the invention, the property of demarcation line shows whether the demarcation line is a line segment whose both endpoints are on a periphery of the design, and the separation line is a line segment whose both endpoints are on the periphery of the design to be separated.

That is, the pieces that make up the design of the quilt are separated by the demarcation lines separating adjacent pieces, and the demarcation lines are understood as line segments.

When both endpoints of the line segment is on a periphery of the design to be separated, a piece can be separated at the line segment as the division line.

For example, as described later in embodiments of the invention, a coordinate of an intersecting point of demarcation lines can be determined as an endpoint of a line segment, so that a line segment that has such an endpoint on the periphery of the design to be separated can be searched.

In another aspect of the invention, the property of the demarcation line shows whether the demarcation line is a line segment whose both endpoints are on a periphery of the design, and the division line is a line segment whose both endpoints are on the periphery of the design to be divided into two.

That is, when both endpoints of the line segment are on the periphery of the design to be divided, the design can be divided into two blocks at the line segment that is the division line.

For example, as described later in embodiments of the invention, a coordinate of an intersecting point of demarcation lines can be determined as an endpoint of a line segment, so that a line segment that has such an endpoint on the periphery of the design to be divided can be searched.

In another aspect of the invention, the applicability determination device to further comprises a determination result informer that informs results determined by the determiner.

That is, the results of the determination as to whether a design for a quilt is applicable to the piecing method can be indicated to a user of the applicability determination device by any form of indication, such as sound, voice, screen display, or by printing onto paper.

In another aspect of the invention, the determination result informer can be so structured as to display the determination results of the determiner on a screen.

That is, the determination results can be displayed on the screen, so that the results can be visually informed.

In another aspect of the invention, the applicability determination device can further comprise a design display that displays the design on the screen.

That is, the design, to be determined as to whether it is applicable to the predetermined piecing method, can be displayed on the screen, such that the determination results can be visually confirmed.

In another aspect of the invention, the data on the piecing order is data that the piecing order is brought into correspondence with separation lines, and the applicability determination device can further comprise a piecing order display that displays a piece separated at the separation line and the piecing order that are corresponded, on the screen.

That is, the separated pieces are to be pieced, so that the piecing order can be indicated by displaying the pieces and the piecing order that are corresponded.

Therefore, the quilt can be easily made regardless of the difference of an individual's experience in quiltmaking.

In another aspect of the invention, the data on the piecing order is data that the separation lines or the division lines are corresponded with the piecing order, and the applicability determination device can further comprise a piecing order display that displays a piece separated at the separation line and a block divided at the division line and the piecing order that are corresponded, on the screen.

Therefore, even when the piecing method requires the joint of the blocks, the quilt can be easily made regardless of an individual's experience or inexperience in joining the blocks.

In another aspect of the invention, the piecing order display can be so structured as to display the separation line as a seam line and the piecing order that are corresponded, on the screen.

That is, when a design is complicated, there may be a case where it is difficult to find the seams for piecing the pieces. However, the seams and the piecing order that are corresponded can be displayed on the screen, so that the quilt can be easily made regardless of an individual's experience in quiltmaking, even when the design is complicated.

In another aspect of the invention, the piecing order display can be so structured as to display the separation lines and division lines that are corresponded, on the screen.

That is, when a design is complicated and is needed to be divided into two blocks, a situation may exist where it is difficult to find the seams for joining the blocks. However, the seams and the piecing order that are corresponded can be displayed on the screen, so that the quilt can be easily made regardless of the difference of an individual's experience in quilt making even when the design is complicated and is needed to be divided into two blocks.

In another aspect of the invention, the applicability determination device can further comprise an inapplicable portion display displaying at least an inapplicable portion of a design when the determiner determines that the design is not applicable to the predetermined piecing method.

That is, the inapplicable portion that is not applicable to the predetermined method can be visually indicated.

In another aspect of the invention, the applicability determination device can further comprise a modifier modifying the design displayed on the screen.

That is, by modifying the design displayed on the screen, an original design can be made. Further, by modifying the inapplicable portion displayed by the inapplicable portion display, the design can be changed so as to be applicable to the predetermined piecing method.

In another aspect of the invention, the piecing order display can be so structured as to display the piecing order in color.

That is, the piecing order can be indicated in color, so that the piecing order can be clarified than that when it is not indicated in color.

In another aspect of the invention, the piecing order display can be so structured as to display the inapplicable portion and the applicable portion of the design in different colors.

Therefore, the portion that is not applicable to the predetermined piecing method can be clarified.

In another aspect of the invention, the piecing order display can be so structured as to display the pieces which are identical in shape, in the same color.

Therefore, the identical shaped pieces can be easily found.

In another aspect of the invention, the applicability determination device can further comprise a memory storing the quilt data.

That is, the memory storing the quilt data is provided, so that it is convenient that the desirable quilt data can be read from the memory.

In another aspect of the invention, the quilt data can be an image that a surface of the quilt is read by a image reader.

That is, the quilt data which is the image read by the image reader can be determined as to whether it is applicable to the predetermined piecing method.

In another aspect of the invention, the predetermined piecing method is a paper piecing that the pieces are stitched on a foundation.

The paper piecing features that a quilt can be easily made by stitching the pieces on paper corresponding to the design. Further, the paper piecing has a typical feature that the quilt is made by repeating piecing the pieces on a piece-by-piece basis. The determination as to whether a design to be made is applicable to the typical feature is difficult to be made with no experience. However, such a determination can be implemented regardless of a difference in experience.

In another aspect of the invention, the applicability determination device can further comprise a determination result printer printing the determination results on a recording medium.

That is, the determination results can be printed on the recording medium, so that the determination results can be stored on the recording medium. Therefore, the data as to whether which design is applicable to a quilt making can be complied.

If a design printer printing the design on the recording medium is provided, the design can be printed on the recording medium, such as paper. Therefore, the paper, on which the design is printed, can be used as a foundation of the paper piecing. Further, the data as to which design is applicable to a quilt making can be stored.

In another aspect of the invention, the applicability determination device can further comprise a piecing order printer printing contents that can be displayed by the piecing order display on the recording medium.

That is, the contents that the separation lines and the piecing order are corresponded, the contents that the separation lines and the division lines and piecing order are corresponded, can be printed on the recording medium, such as paper. Therefore, the printed paper can be used as a foundation of the paper piecing. Further, a collection of foundations can be made by collecting the printed papers.

In another aspect of the invention, the applicability determination device can further comprise an inapplicable portion printer printing at least the inapplicable portion of the design on the recording medium when the design is determined as being inapplicable to the predetermined piecing method by the determiner.

That is, the portion that is not applicable to the predetermined piecing method can be printed on the recording medium such as paper, so that the data as to the inapplicable design can be complied by collecting the printed papers.

In another aspect of the invention, the inapplicable portion printer can be so structured as to print the portion where it is not applicable and the portion where it is applicable in different colors.

That is, the portion that is not applicable to the predetermined piecing method can be printed in a different color from the portion that is applicable, so that the portion that is not applicable to the piecing method can be clarified.

In another aspect of the invention, the piecing order printer can be so structured as to print the pieces that are identical in shape in the same color.

That is, the pieces that are identical in shape can be printed on the recording medium, such as paper, in the same color. Therefore, the number of shaped pieces that are needed can be easily found if the printed paper is used as a foundation for the paper piecing.

BRIEF DESCRIPTION OF THE DRAWINGS

A preferred embodiment of the present invention will be described in detail with reference to the following figures wherein:

FIG. 4 is a diagram showing an endpoint information list for recording coordinates of endpoints of line segments structuring a design;

FIG. 5 is a diagram showing a matrix of endpoint connection;

FIGS. 6A and 6B are diagrams showing lists of line segment data;

FIG. 8A is a diagram showing a list of separation line data which is analytical results obtained at a demarcation line analysis processing;

FIG. 8B is a diagram showing a list of generated piecing order;

FIGS. 9A and 9B are diagrams showing a cutting data list to be stored in the RAM;

DETAILED DESCRIPTION OF THE PREFERRED EMBODIMENTS

Embodiments of an applicability determination device for quilt design (hereinafter referred to as a determination device) and a memory medium of the invention will be described with reference to the accompanying drawings.

In each of the embodiments described below, as the determination device of the invention, a device which determines whether a quilt design is applicable to the paper piecing, will be described.

Figure 1:
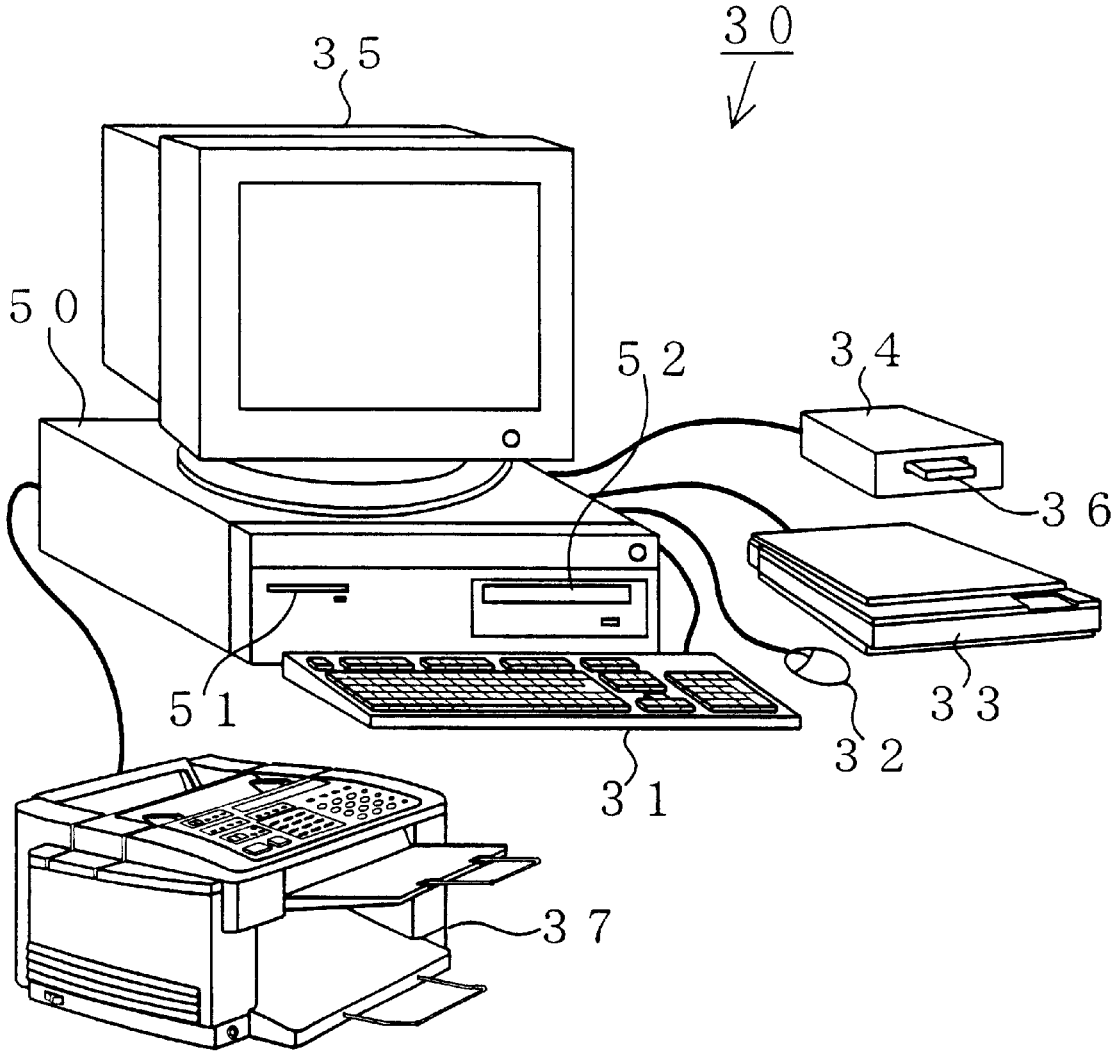
FIG. 1 illustrates an applicability determination device according to a first embodiment of the invention.

FIG. 1 illustrates a determination device 30 of a first embodiment. As shown in FIG. 1, in the determination device 30, a computer 50 is provided. A keyboard 31, a mouse 32, a color image scanner 33, a flash memory device 34, a CRT display 35, and a printer 37 are electrically connected to the computer 50.

The keyboard 31 and the mouse 32 are used for drawing a quilt design as well as for controlling the computer 50. The color image scanner 33 reads a quilt design printed in printed matters, as an image data, and sends the read image data to the computer 50. The flash memory device 34 is so structured that a RAM card 36 can be inserted thereinto and withdrawn therefrom. The flash memory device 34 reads the data, such as a quilt design, from the inserted RAM card 36 and sends the read data to the computer 50. Further, the flash memory device 34 writes the data, such as a quilt design, sent from the computer 50 into the RAM card 36. The printer 37 prints the created quilt design or the like onto a recording medium, such as paper.

The computer 50 executes an applicability determining processing to determine whether the quilt design sent from the color image scanner 33 or the flash memory device 34 is applicable to the paper piecing. Further, the computer 50 executes displaying processing to display determination results and the quilt design or the like to be determined on the CRT display 35. In the computer 50, a floppy disk drive (FDD) 51, which reads/writes the data from/into a floppy disk, and a CD-ROM drive (CD-ROMD) 52, which reads the data from a CD-ROM, are provided.

Figure 2:
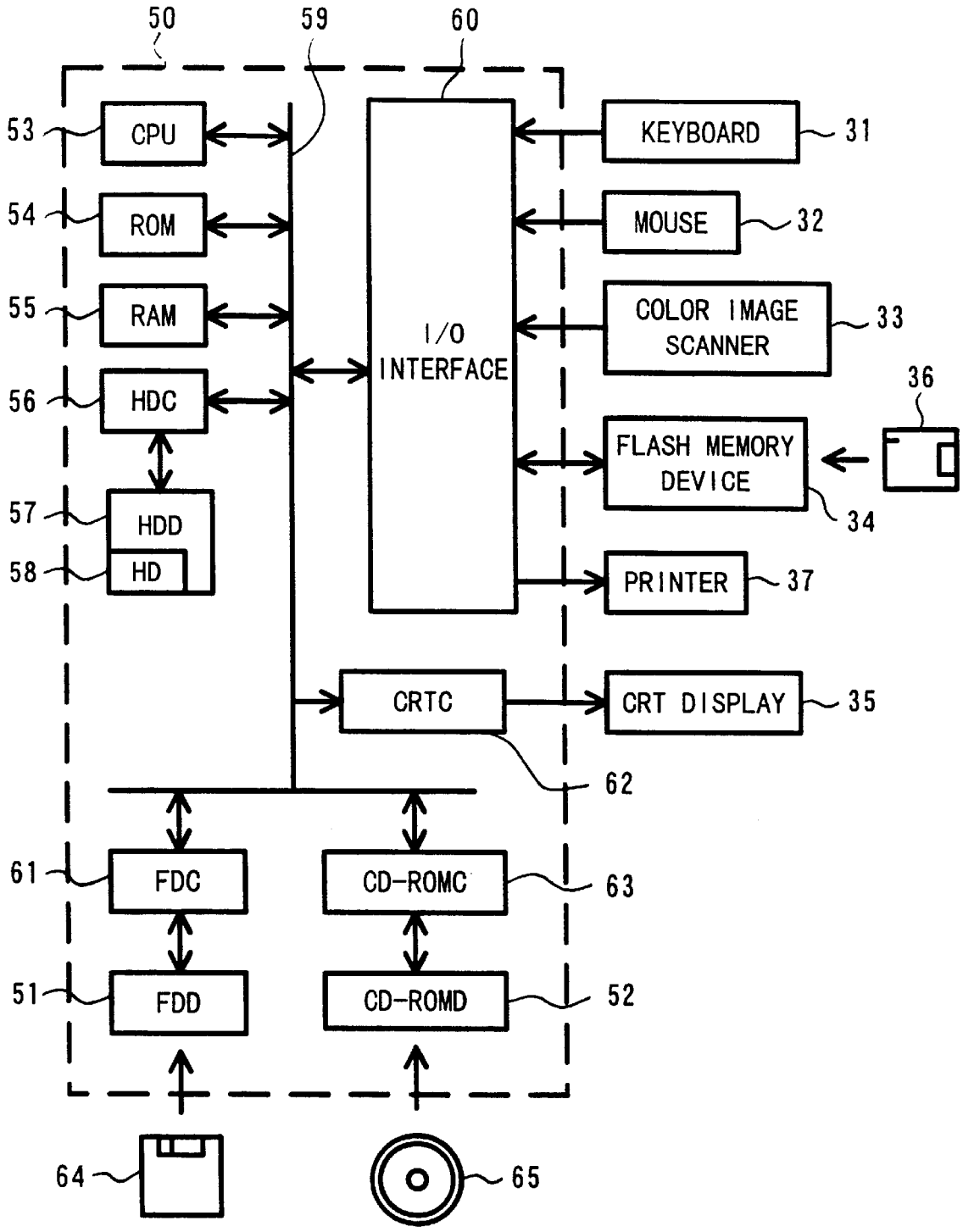
FIG. 2 is a block diagram showing a main electrical structure of the applicability determination device.

Next, an electrical structure of the determination device 30 will be described with reference to FIG. 2. FIG. 2 is a block diagram showing a main electrical structure of the determination device 30.

In the computer 50, a CPU 53, which executes the applicability determining processing, the displaying processing, or the like, is built-in. A ROM 54, a RAM 55, and a hard disk controller (HDC) 56 are connected to the CPU 53 via a bus 59. A hard disk drive (HDD) 57 is connected to the hard disk controller 56, and reads/writes the data from/into a hard disk (HD) 58 built-in the computer 50.

A startup program or the like for booting the computer 50 when power is turned on are stored in the ROM 54. The RAM 55 temporary stores the startup program read from the ROM 54 and various programs and the data read from the hard disk 58.

An I/O interface 60 is connected to the bus 59. The keyboard 31, the mouse 32, the color image scanner 33, the flash memory device 34, the CRT display 35, and the printer 37 are connected to the I/O interface 60.

Figure 3A:
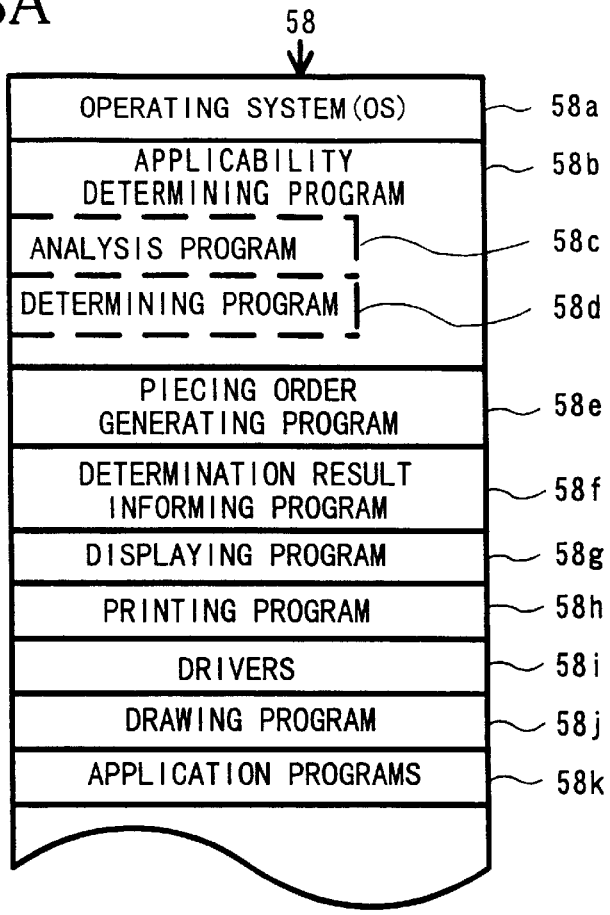
FIG. 3A is a diagram showing memory contents in a hard disk (HD)

Next, memory contents in the hard disk 58 will be described with reference to FIG. 3A.

In the hard disk 58, an operating system (OS) 58*a* and an applicability determining program 58*b* that executes the applicability determining processing described above are stored. For the operating system 58*a*, MS-Windows of Microsoft (Windows is a trademark of Microsoft Corporation), MS-DOS, or the like is used.

The applicability determining program 58*b* has an analysis program 58*c* and a determining program 58*d*. The analysis program 58*c* analyzes demarcation lines constructing a pattern of the created quilt design. The determining program 58*d* determines whether the quilt design shown by the quilt design data is applicable to the paper piecing, based on the analytical results of the analysis program 58*c*.

In the hard disk 58, a piecing order generating program 58*e*, a determination result informing program 58*f*, displaying program 58*g*, and a printing program 58*h* are stored. The piecing order generating program 58*e* generates a piecing order data to display the piecing order based on the analytical result. The determination result informing program 58*f* informs the determination results. The displaying program 58*g* displays the created quilt design and the determination results on the CRT display 35. The printing program 58*h* prints the created quilt design or the like using the printer 37.

Further, stored in the hard disk 58 are various drivers 58*i*, which enable the color image scanner 33, the flash memory device 34, the CRT display 35, and the printer 37 to be operated, a drawing program 58*j* that draws a quilt design, and various application programs 58*k* for software for a word processor.

Figure 3B:
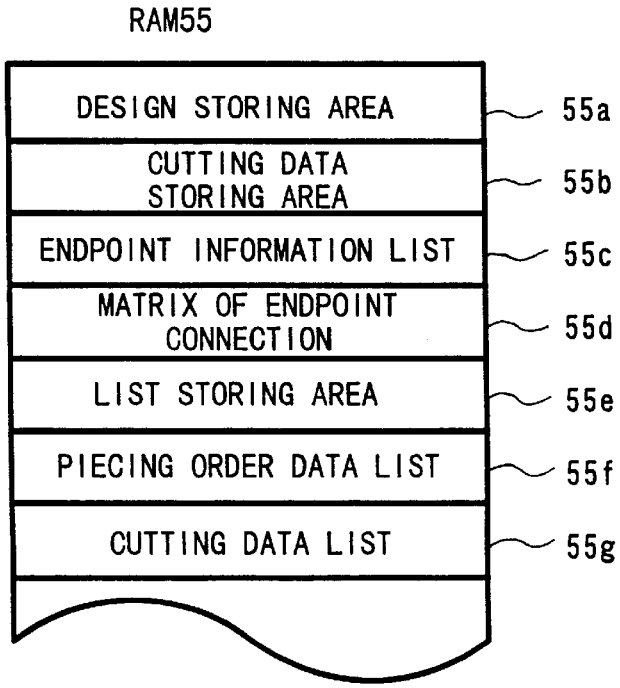
FIG. 3B is a diagram showing a structure of a RAM.

FIG. 3B describes the structure of the RAM 55, wherein the RAM 55 comprises a design storing area 55*a*, which stores data of the created quilt design, and a cutting data storing area 55*b*, which stores cutting data showing the separated pieces or divided blocks when the determining processing is performed. Further, the RAM 55 temporarily stores the processing results processed by the CPU 53 or the programs read from the hard disk 58.

Figure 10:
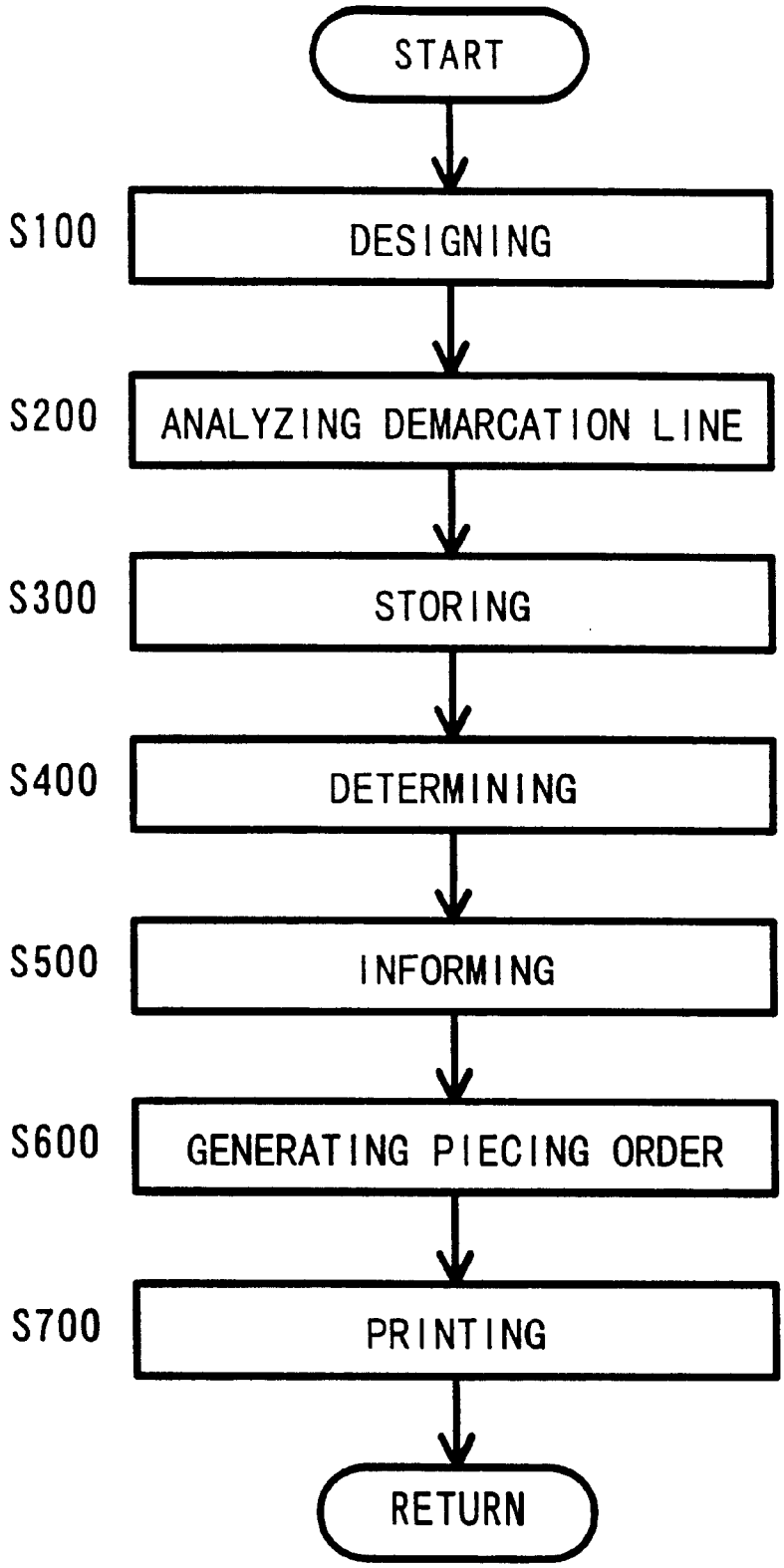
FIG. 10 is a flowchart of main operation executed by a CPU.

Next, a main processing executed by the CPU 53 will be described with reference to a main flowchart in FIG. 10.

A case that the paper piecing is used as the piecing method for quiltmaking will be described, for example.

The CPU 53 executes a designing processing (S100 (hereinafter, S stands for a step)), a demarcation line analysis processing (S200), a storing processing (S300), a determining processing (S400), a displaying processing (S500), a piecing order data generating processing (S600), and a printing processing (S700).

In the designing processing (S100), a processing to draw a quilt design is performed by a person who operates the determination device 30 (FIG. 1) (hereinafter referred to as an operator). For this processing, the drawing program 58*j* is used and a quilt design is drawn using the keyboard 31 and the mouse 21.

In the demarcation line analysis processing (S200), the quilt design drawn at the designing processing (S100) is analyzed as to which kinds of demarcation lines construct each diagram.

In the storing processing (S300), a processing stores the quilt design drawn at the designing processing (S100) and the analytical results analyzed at the demarcation line analysis processing (S200).

In the determining processing (S400), a determination is made as to whether the quilt design drawn at the designing processing (S100) is applicable to the paper piecing, based on the analytical results of the demarcation line analysis processing (S200).

In the displaying processing (S500), a processing to display the quilt design drawn at the designing processing (S100), the results analyzed at demarcation line analysis processing (S200), and the determination results determined at the determining processing (S400), on the CRT display 35, is performed.

In the piecing order data generating processing (S600), the piecing order data showing the order of piecing pieces is generated based on the quilt design drawn at the designing processing (S100), the result analyzed at the demarcation line analysis processing (S200), and the results determined at the determining processing (S400). The generated piecing order data is displayed on the CRT display 35.

In the printing processing (S700), a processing to print the quilt design drawn at the designing processing (S100), the results analyzed at the demarcation line analysis processing (S200), the results determined at the determining processing (S400), the piecing order data generated at the piecing order data generating processing (S600), or the like onto paper for the paper piecing using the printer 37, is performed.

Figure 11:
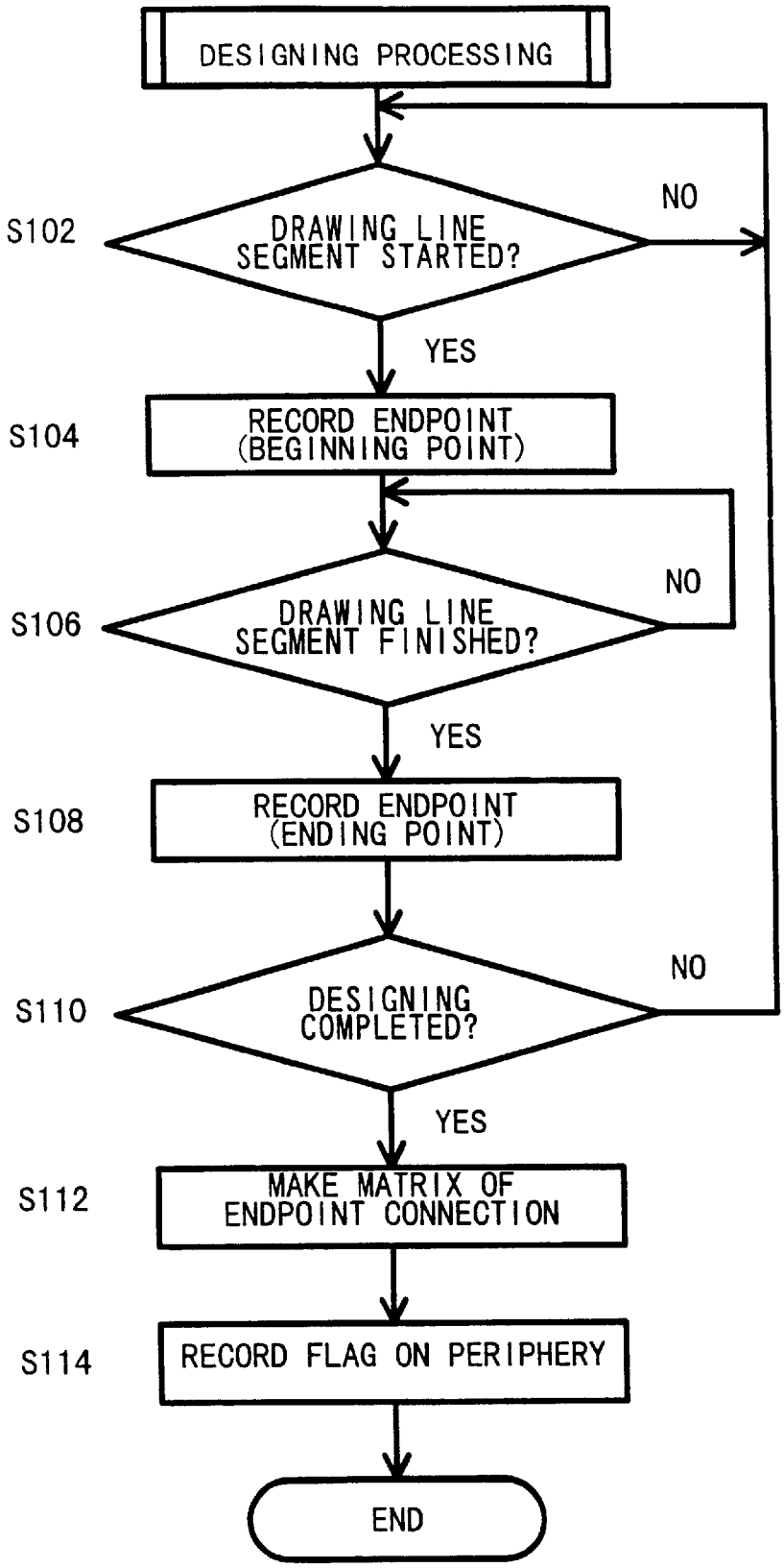
FIG. 11 is a flowchart of designing processing.

Next, the designing processing (S100) executed by the CPU 53 will be described with reference to FIGS. 4 and 11.

FIG. 4 is a diagram showing an endpoint information list 55*c* for recording coordinates of endpoints of line segments constructing a design. FIG. 11 is a flowchart of the designing processing.

Figure 24:
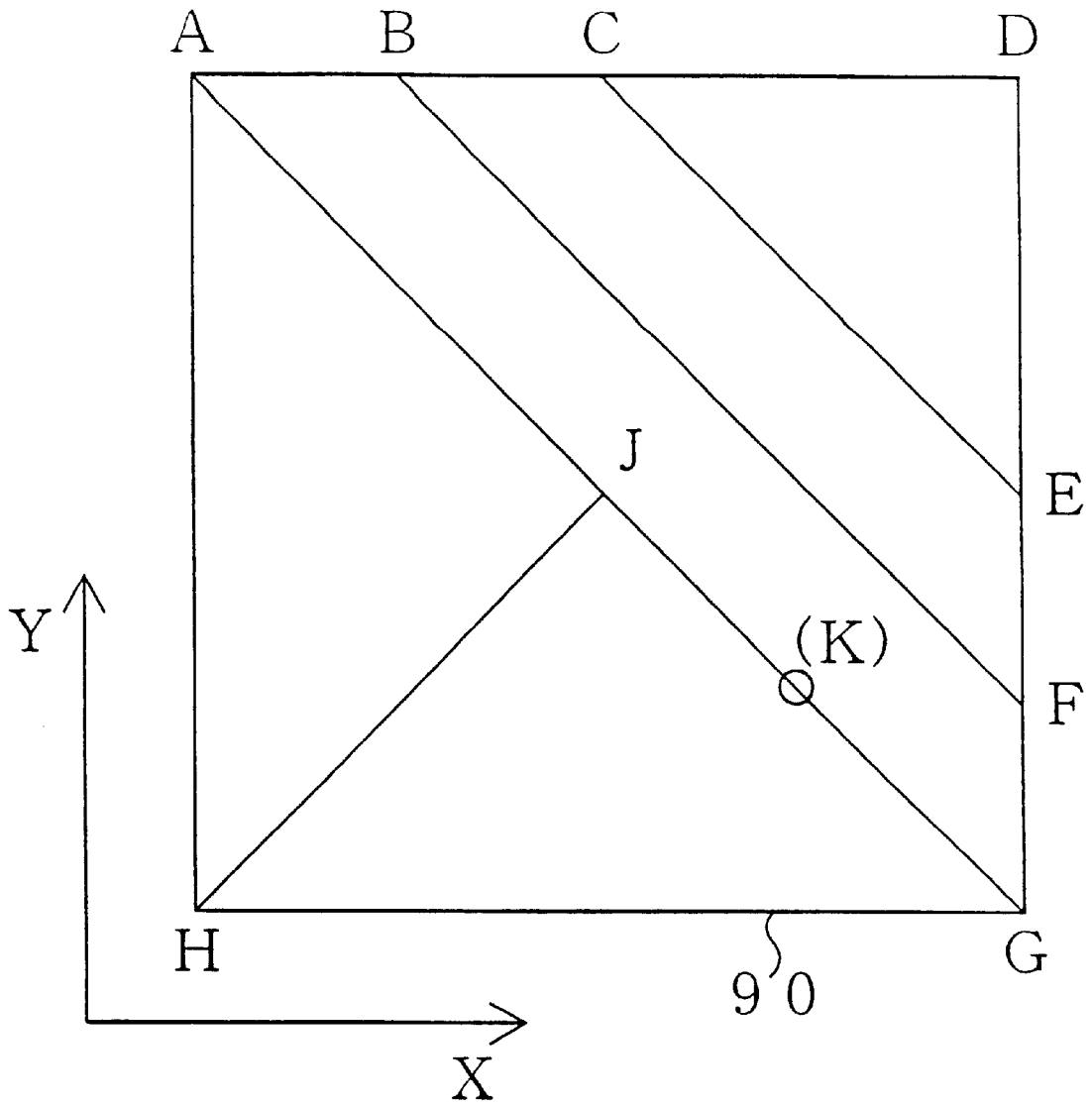
FIG. 24 illustrates a quilt design.

It is assumed that the operator draws a quilt design shown in FIG. 24 using the mouse 32. Line segment data drawn at the designing processing will be stored in the RAM 55 by a drawing data storing processing (S302) at the storing processing shown in FIG. 13.

When the CPU 53 detects that the operator starts drawing a line segment using the mouse 32 (S102:Yes), the CPU 53 records a coordinate of an endpoint (beginning point) of the line segment in the endpoint information list 55*c* (FIG. 4) in the RAM 55 (S104). A position where the operator first clicks the mouse 32 is detected as the coordinate of the endpoint (beginning point) and is determined as an endpoint A. The x and y coordinates (xa, ya) of the endpoint A are recorded in the endpoint information list 55*c* (FIG. 4).

Then, when the CPU 53 detects the completion of drawing of the line segment (S106:Yes), the CPU 53 records a coordinate of an endpoint (ending point) in the endpoint information list 55*c* (S108). A position where the operator secondly clicks the mouse 32 is detected as the coordinate of the endpoint (ending point) and is determined as an endpoint B. The x and y coordinates (xb, yb) of the endpoint B are recorded in the endpoint information list 55*c* (FIG. 4).

As described above, the CPU 53 continues executing the S102 through S108 and records x and y coordinates of endpoints C through J in the endpoint information list 55*c* until the CPU 53 detects the completion of the drawing of the quilt design at the next S110.

Then, the CPU 53 makes a matrix of endpoints connection 55*d* shown in FIG. 5 based on the x and y coordinates of endpoints A through J recorded in the endpoint information list 55*c* (S112). The matrix of endpoints connection 55*d* shows the connection between each endpoint. In the figure, O means that the endpoints construct a line segment, and X means that the endpoints do not construct a line segment. However, when there is another endpoint between endpoints, X is indicated because the line segments overlap each other.

For example, as shown in FIG. 24, the endpoints A and B construct a line segment, so that O is indicated. Between the endpoints A and C, there is the endpoint B, so that X is indicated in the endpoint connection list 55*c* shown in FIG. 4.

Then, the CPU 53 records a flag on the periphery showing whether there are endpoints on a periphery 90 (FIG. 24) of the quit design in the endpoint information list (S114). As shown in FIG. 24, all endpoints A through H are on the periphery 90, so that the flag on the periphery 1 is recorded and the endpoint J is not on the periphery 90, so that the flag on the periphery 0 is recorded.

Figure 12:
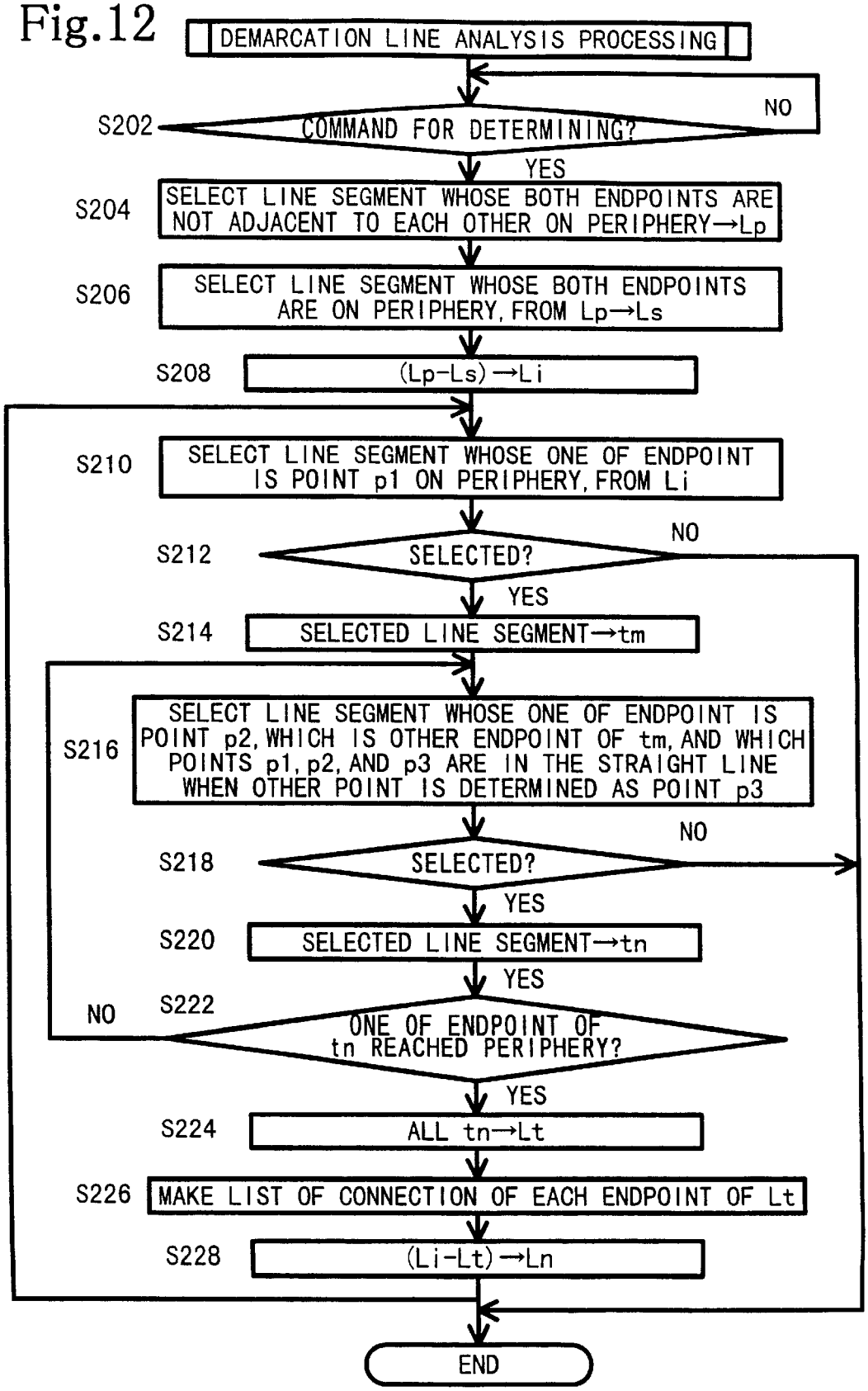
FIG. 12 is a flowchart of demarcation line analysis processing.

Next, the demarcation line analysis processing (S200 in FIG. 10) will be described with reference to a flowchart of FIG. 12.

The demarcation line analysis processing is a processing to make data to be used for a determination at the determining processing (S400 in FIG. 10) as to whether the quilt design shown in FIG. 24 is applicable to the paper piecing. Therefore, the demarcation line analysis processing is executed when a command for determination is issued by the operator. The determining processing (S400 in FIG. 10) is executed following the demarcation line analysis processing.

Figure 13:
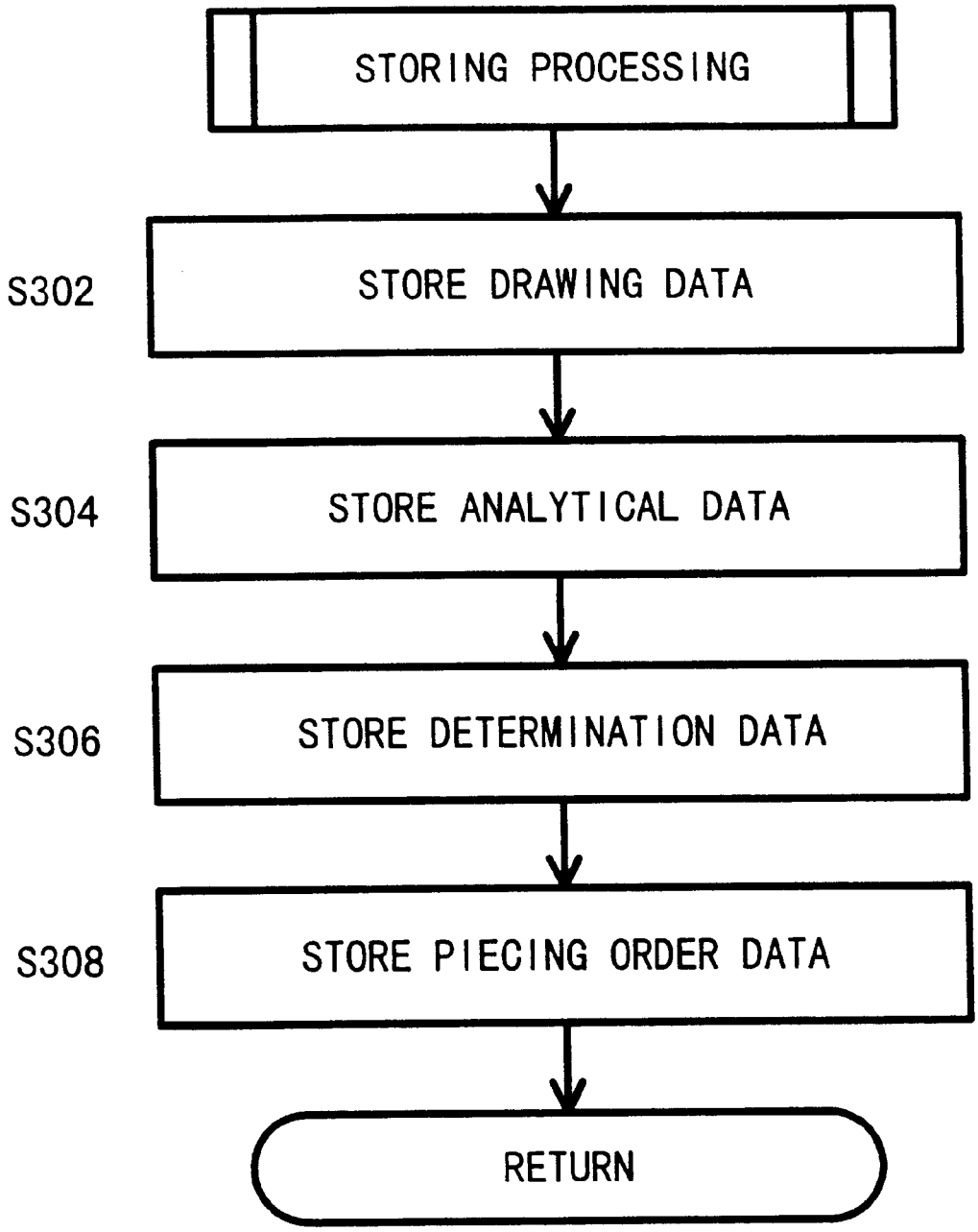
FIG. 13 is a flowchart of storing processing.

The results of the demarcation line analysis processing will be stored in the RAM 55 by the analysis data storing processing of the storing processing shown in FIG. 13 (S304).

When the CPU 53 detects that a command for executing the determination described above is issued by the operator (S202:Yes), the CPU 53 makes a list Lp of the endpoints of the line segments whose endpoints are not adjacent to each other on the periphery 90, with reference to the endpoint information list 55*c* (FIG. 4) and the matrix of endpoints connection 55*d* (FIG. 5) (S204). As shown in FIG. 24, the line segments, whose endpoints are not adjacent to each other on the periphery 90, are AJ, BF, CE, JG, and HJ, so that {(A, J), (B, F), (C, E), (J, G), (H, J)} is indicated in the list Lp of both endpoints of the line segments as shown in FIG. 6A. The list Lp will be stored in a list storing area 55*e* (FIG. 3B) of the RAM 55.

Then, the CPU 53 selects the line segments, whose both endpoints are on the periphery 90, from the list Lp, and makes a list Ls using the selected line segments (S206). As shown in FIG. 24, the line segments whose both endpoints are on the periphery 90 are CE and BF, so that {(C, E), (B, F)} is indicated in the list Ls as shown in FIG. 6A. The list Ls will be stored in the list storing area 55*e* in the RAM 55.

Then, the CPU 53 eliminates the list Ls obtained at S204 from the list Lp obtained at S206 (Lp−Ls). The line segments obtained from the elimination are listed in a list Li (S208). The list Li shows the endpoints of the line segments having at least one of its endpoints that is not on the periphery 90 (hereinafter referred to as an inside endpoint). That is, a line segment whose both endpoints are inside endpoints will be included in the list Li (in the quilt design shown in FIG. 24, there is no such line segment).

After that, the CPU 53 selects the line segment, whose one of the endpoint is a point p1 on the periphery 90, from the list Li (S210). For example, it is assumed that the point p1 is the endpoint A. The line segment AJ whose one endpoint is the endpoint A is selected. Then, the CPU 53 detects that the selection of the line segment is completed (S212:Yes), and the selected line segment is determined as a list element tm (S214).

Next, the CPU 53 selects the line segment whose one endpoint is a point p2, which is the other endpoint of the list element tm obtained at S212, and which the points p1, p2, and p3 on the line segment are in the straight line when the other point is determined as the point p3 (S216).

For example, it is assumed that the list element tm is the line segment AJ, the other endpoint, the point p2, is the endpoint J. Therefore, the line segment whose one endpoint is the endpoint J is selected. The line segments whose one endpoint is the endpoint J are the line segments GJ and HJ. It is assumed that the other endpoint, the point p3, is the endpoint H, (p1, p2, p3)=(A, J, H) does not hold because the points (A, J, H) are not in the straight line, as shown in FIG. 24. On the other hand, if the other endpoint, the point p3, is the endpoint G, (p1, p2, p3)=(A, J, G). As shown in FIG. 24, the endpoints (A, J, G) are in a straight line, so that the line segment AJG is selected (S216).

Then, the CPU 53 determines that the selection of line segment is completed (S218:Yes), and the line segment, which is selected at S216, is determined as a list element tn (S220). After that, the CPU 53 determines whether one of the endpoints of the list element tn has reached the periphery 90 (S222). This determination determines whether all list elements tn are selected.

For example, as shown in FIG. 24, when there is an endpoint K between the endpoints J and G, the line segments JK and KG are selected for the list element tn as being in the straight line of an extension of the line segment of AJ.

In this case, when the CPU determines that the endpoint G, which is one of the endpoints of list element tn, has reached the periphery 90 (S222:Yes), it means all list elements tn are selected.

When the CPU 53 determines that one of the endpoints of list element tn has reached the periphery 90 (S222:Yes), the CPU 53 determines all list elements tn as a list Lt (S224).

For example, it is assumed that the selected list elements tn are (A, J) and (J, G) by repeating S216 through S222, Lt={(A, J), (J, G)} (S224).

Then, the CPU 53 makes a list Lm showing the connection of each endpoints of the list Lt (S226).

For example, when Lt={(A, J), (J, G)}, as shown in FIG. 6B, Lm={(A, J, G)}.

Next, the CPU 53 eliminates the list element tn in the list Lt from the list Li, and the remaining elements are determined as list element Ln (S228).

For example, when Li={(A, J), (J, G), (H, J)} and Lt={(A, J), (J, G)}, Ln=Li−Lt={(H, J)} (S228).

As described above, the analysis of all demarcation lines is completed, and as shown in FIG. 6B, the lists Ls, Lm, and Ln are obtained according to the properties of demarcation lines.

Next, the determining processing (S400) executed by the CPU 53 will be described with reference to FIGS. 7A through 7E, 14, and 25A through 25F.

Figure 14:
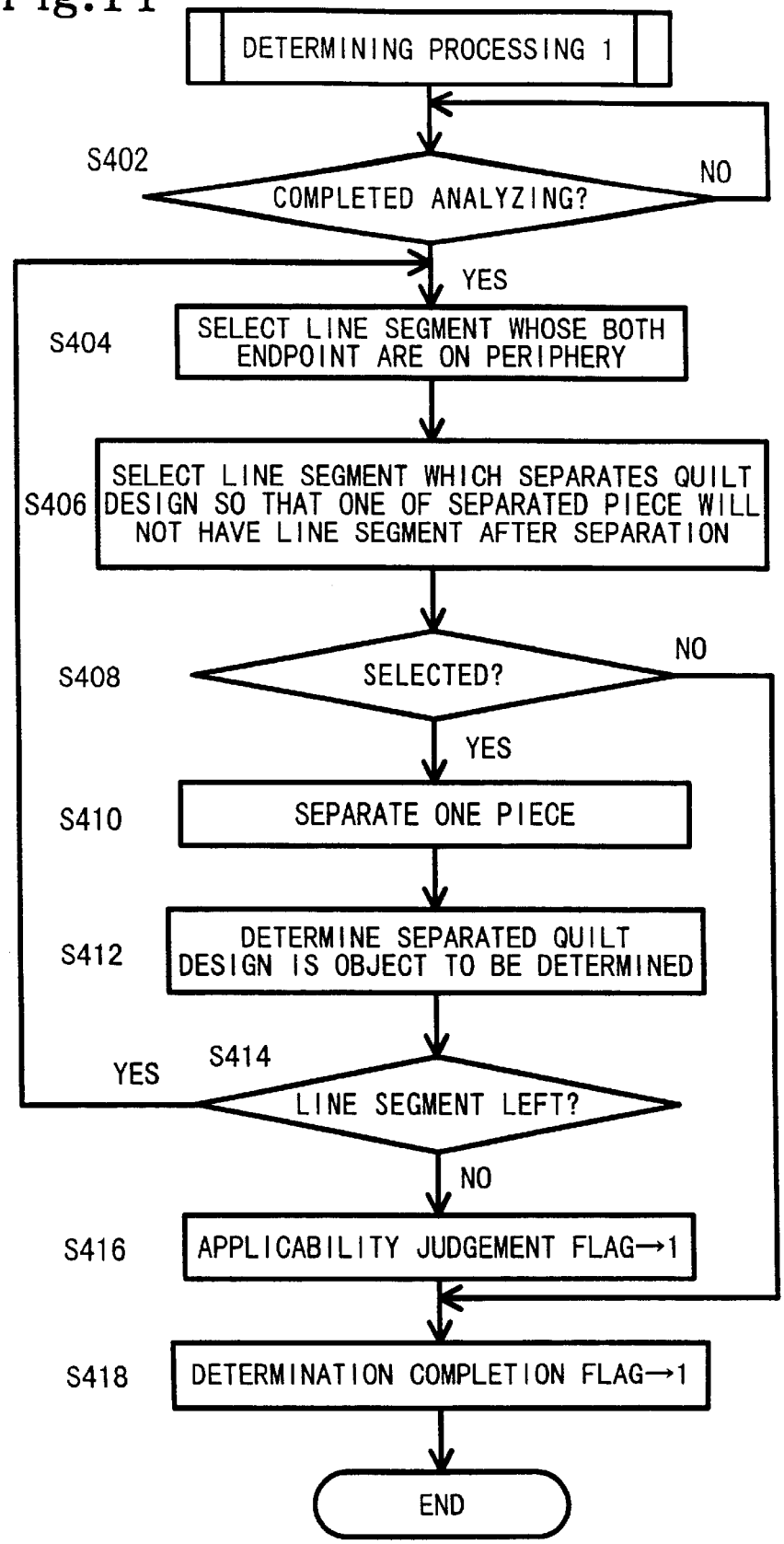
FIG. 14 is a flowchart of determining processing 1.

FIGS. 7A through 7E show a process of eliminating the line segment data from the list storing area 55*e* shown in FIG. 6B. FIG. 14 is a flowchart of determining processing 1. FIGS. 25A through 25E show a process of separating a quilt design on a piece-by-piece basis.

In this embodiment, it is assumed that the operator has drawn the quilt design shown in FIG. 24 which was used for the example in the analysis processing. The determination as to whether the quilt design is applicable to the paper piecing will be described. Various determination results of the determining processing 1 will be stored in the RAM 55 by a determination data storing processing (S306) at the storing processing shown in FIG. 13.

When the CPU 53 detects the completion of the analysis processing (S200) (S402:Yes), the line segment data wherein the flags on the periphery are set as both endpoints, that is, the line segment whose both endpoints are on the periphery 90, is selected from the list storing area 55*e* with reference to a list 55*f* (FIG. 7A) and the endpoint information list 55*c* (S404) stored in the RAM 55. This processing is performed by determining whether the flags on the periphery are set on the applicable endpoints, with reference to the endpoint information list 55*c*. In this embodiment, the line segments BF and CE are selected.

Then, the CPU 53 selects the line segment, which separates a piece so that the separated piece will not have a line segment after separation. The selected line segment is determined as a line segment (hereinafter referred to as a separation line) to be used for separating a piece (S406).

The determination is performed, for example, using the following method.

In the FIG. 24, the endpoint H is determined as an origin point of the x and y coordinates. A direction toward the endpoint G from the endpoint H is determined as a normal direction of the x coordinate, and a direction toward the endpoint A from the endpoint H is determined as a normal direction of the y coordinate. The endpoint B of the line segment BF is focused, and the detection is performed as to whether there are other endpoints in the normal direction of the x coordinate from the endpoint B. In FIG. 24, in the normal direction of the x coordinate from the endpoint B, there is the other endpoint C.

The endpoint F of the line segment BF is focused, and the detection of other endpoints is performed in the normal direction of the y coordinate from the endpoint F. As a result, in the normal direction of the y coordinate, there is the other endpoint E.

In short, as described above, the detection is performed in the normal direction of x and y coordinates from the focused endpoint. When the other endpoint is detected, the line segment BF having the focused endpoint is eliminated from the subject of the determination.

On the other hand, when the endpoints C and E of the line segment CE are focused and the detection is performed, there are no other endpoints. Therefore, the line segment CE is applicable to the determination.

Figure 7A:
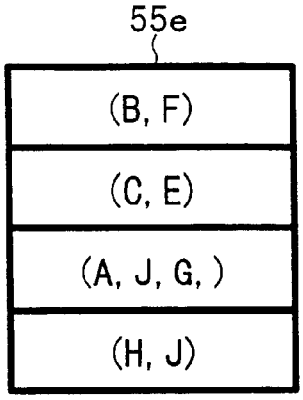
FIGS. 7A through 7E are diagrams showing a process of eliminating the line segment data in the list shown in FIG. 6B from a list storing area.
Figure 7B:
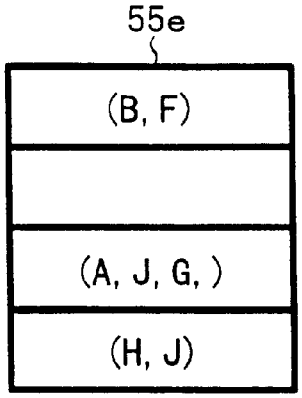
Figure 25A:
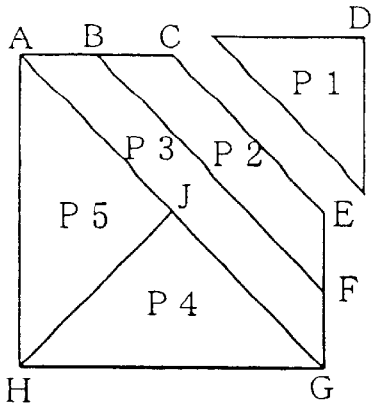
FIGS. 25A through 25F illustrate a process of separating a quilt design on a piece-by-piece basis.

Then, the CPU 53 determines that the selection is completed (S408:Yes), and the CPU 53 separates a piece from the quilt design at the selected line segment which is determined as the separation line (S410). In this embodiment, as shown in FIG. 25A, a piece P1 is separated at the separation line CE (S410). Therefore, as shown in FIG. 7B, the line segment data (C, E) is eliminated from the list storing area 55*e*. An image data showing the piece separated by the separation will be stored in the RAM 55.

After that, the CPU 53 determines that the quilt design whose one piece has been separated is the object to be determined (S412), and determines whether the line segments exist in the quilt design after separation (S414).

In short, the CPU 53 determines whether the line segment data remains in the list storing area 55*e* (S414). In this embodiment, as shown in FIG. 7B, because line segment data is in the list storing area 55*e* (S414:Yes), the CPU 53 returns to S404 and selects the line segment wherein the flags on the periphery are set on the both endpoints from the list storing area 55*e*. In this embodiment, the line segments BF, AJG, and HJ are selected (S404).

Figure 7C:
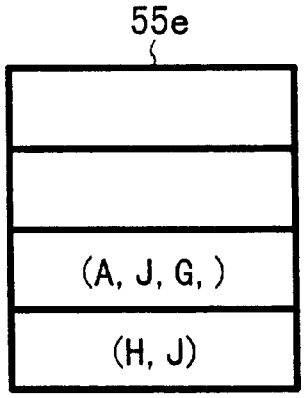
Figure 25B:
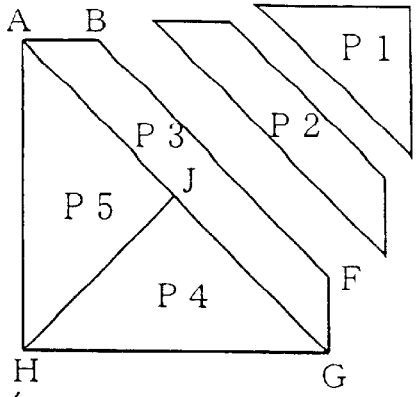

Then, the CPU 53 selects the line segment BF, which separates a piece from the quilt design so that the separated piece will not have a line segment to become the separation line, from the selected line segments, after separation (S406). After that, the CPU 53 determines that the selection is completed (S408:Yes), and as shown in FIG. 25B, separates a piece P2 from the quilt design at the selected line segment BF which is determined as the separation line (S410). Therefore, as shown in FIG. 7C, the line segment data (B, F) is eliminated from the list 55*c*.

Next, the CPU 53 determines that the quilt design whose one piece has been separated is the object to be determined (S412). As shown in FIG. 7C, in the list storing area 55*e*, there are the line segment data (A, J, G) and (H, J), so that the CPU 53 returns to S404 (S414:Yes).

Then, the CPU 53 selects the line segment data (A, J, G) and (H, J), wherein the flags on the periphery are set on the both endpoints, from the list storing area 55*e* (S404), and selects the line segment data (A, J, G), which separates a piece form the quilt design so that one of the separated piece will not have a line segment to become the cutting line, from the selected line segments, after separation (S406).

Figure 7D:
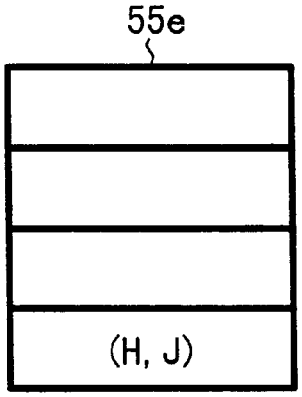
Figure 7E:
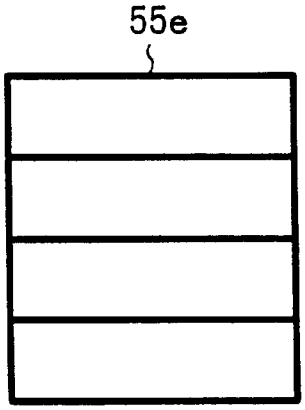
Figure 25C:
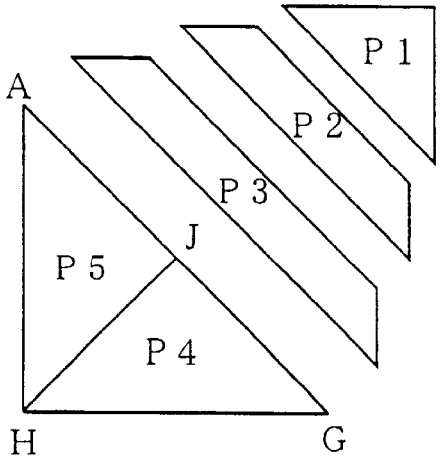
Figure 25D:
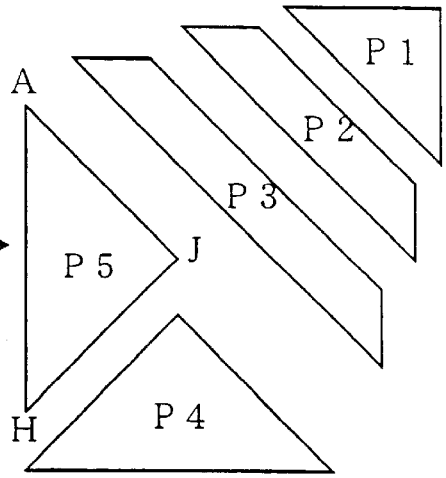

After the CPU 53 detects that the selection is completed (S408:Yes), as shown in FIG. 25C, a piece P3 is separated by the selected line segment AJG which is determined as the cutting line (S410). Because of the processing, as shown in FIG. 7D, the line segment data (A, J, G) is eliminated from the list storing area 55*e*. Next, the CPU 53 determines that the quilt design whose one piece has been cut is the object to be judged (S412). As shown in FIG. 7C, in the list storing area 55*e*, there is the line segment data (H, J). Therefore, the CPU 53 returns to S404 (S414:Yes).

Then, the CPU 53 selects the line segment data (H, J), wherein the flags on the periphery are set on the both endpoints, from the list storing area 55*e* (S404), and the CPU 53 selects the line segment data (H, J), which separates a piece from the quilt design so that the separated piece will not have a line segment to become the separation line, from the selected line segments, after separation (S406).

Then, after the CPU 53 detects that the selection is completed (S408:Yes), as shown in FIG. 25, a piece P4 is separated at the selected line segment HJ which is determined as the separation line (S410). Therefore, as shown in FIG. 7D, the line segment data (H, J) is eliminated from the list storing area 55*e*. Then, the CPU 53 determines that the quilt design whose one piece has been separated is the object to be determined (S412). However, this time there is no line segment data in the list storing area 55*e*, so that the CPU 53 goes to S416. At S416, an applicability determination flag, which shows that the quilt design is concluded to be applicable to the paper piecing, is set and a determination completion flag, which shows the completion of the determining processing, is set (S418).

On the other hand, the determining processing is finished (S418) when there is a line segment left in the quilt design after separation (S414:Yes) and the line segment, which separates the quilt design so that the separated piece will not have a line segment to become the separation line, from the selected line segments, after separation, cannot be selected (S406, S408:No), though the line segment whose both endpoints are on the periphery is selected (S404).

Figure 26A:
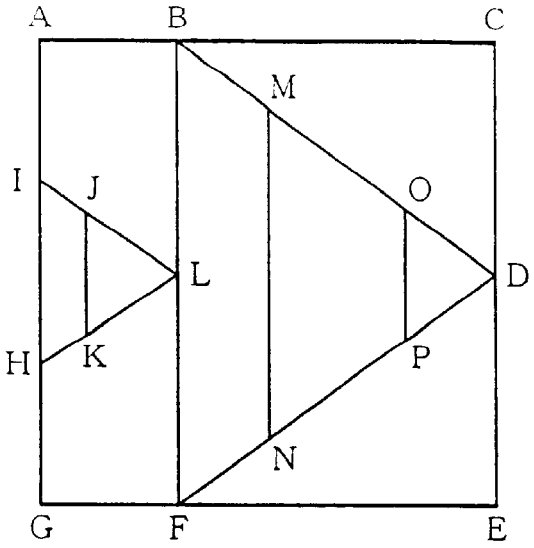
FIGS. 26A through 26C illustrate quilt designs.
Figure 26B:
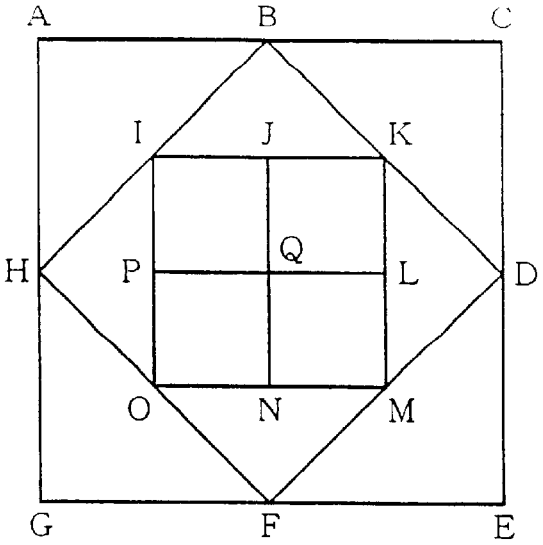

For example, in the quilt design "boxes" shown in FIG. 26B, when an area enclosed with lines connecting points I, J, K, L, M, N, O, and P is focused, a piece cannot be separated from the quilt design at either line segment JN or PL.

Therefore, the quilt design including such an area is not applicable to the paper piecing.

Next, the displaying processing (S500 in the FIG. 10) executed by the CPU 53 will be described with reference to FIG. 15.

When the CPU 53 determines that a line segment is being drawn (S501:Yes), the CPU 53 displays the line segment being drawn on the CRT display 35 (S502). The CPU 53 keeps on displaying the line segment until the determining processing (S400) is completed (S504:No). When the CPU 53 detects the completion of the determining processing (S504:Yes), the CPU 53 determines whether the applicability determination flag is set (S506). When the CPU 53 determines that the applicability determination flag is set (S506:Yes), the CPU 53 displays a message informing an affirmative determination on the CRT display 35. When the CPU 35 determines that the applicability determination flag is not set (S506:No), the CPU 35 displays an inapplicable portion and a message informing a negative determination on the CRT display 35 (S510).

The message informing the affirmative determination is such that "This quilt design can be made by the paper piecing." The message informing the negative determination is such that "This quilt design cannot be made by the paper piecing."

These messages are displayed on the CRT display 35. Further, these messages may be played audibly, such as in voice.

Figure 28:
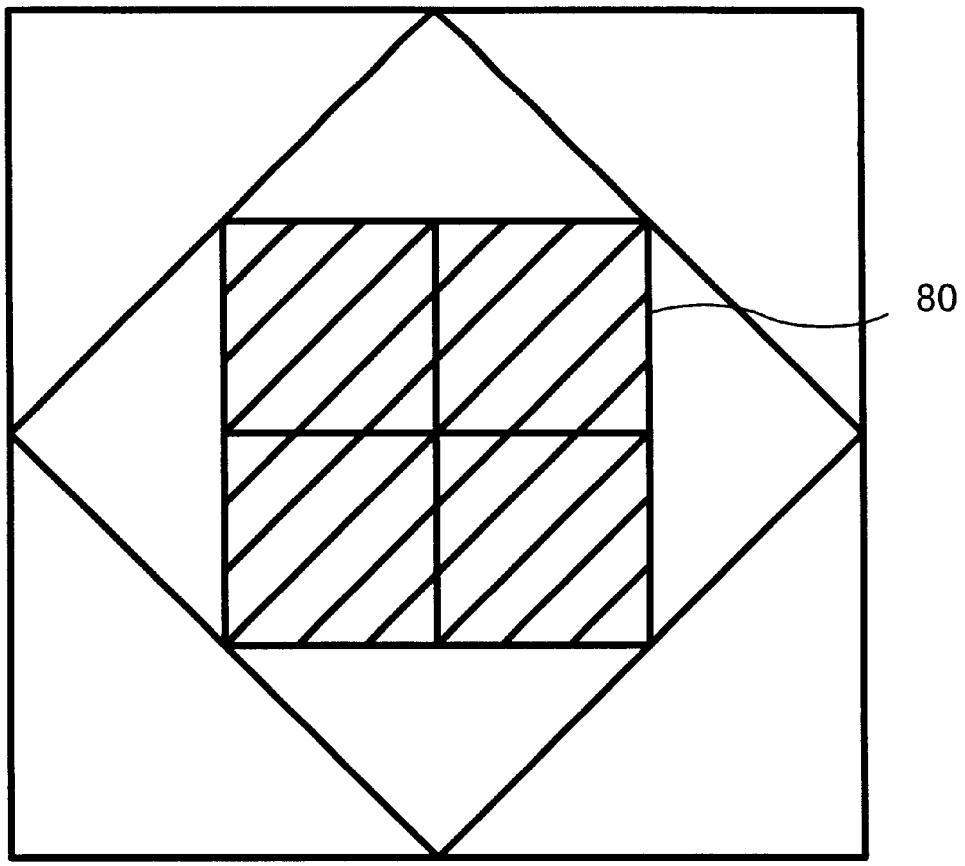
FIG. 28 illustrates an inapplicable portion of a quilt design.
Figure 31A:
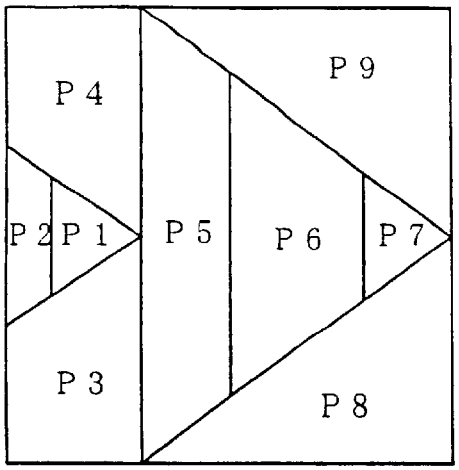
FIGS. 31A through 31C illustrate quilt designs.
Figure 31B:
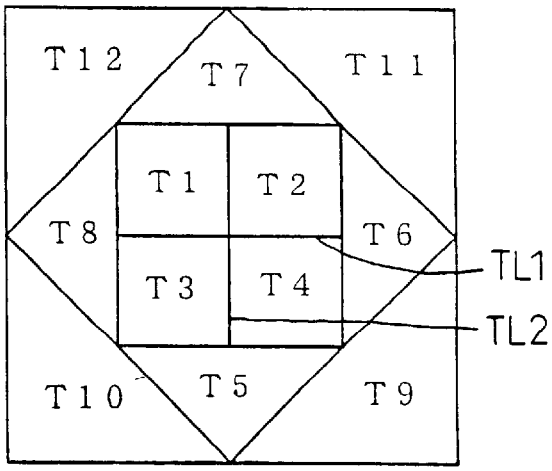

FIG. 28 illustrates an inapplicable portion 80 displayed on the CRT display 35 when the negative determination is issued as a result of drawing the quilt design "boxes" shown in FIG. 31B.

The inapplicable portion 80 (diagonally shaded area) is indicated in a different color from other portions, so that the inapplicable portion 80 is easily identified. Further, the periphery of the inapplicable portion 80 may be indicated with a thicker line than the other portions or in a different color from the other portions. Furthermore, the inapplicable portion 80 may be flashed.

As described above, the operator can notice the determination results by looking or listening to the message.

Figure 31C:
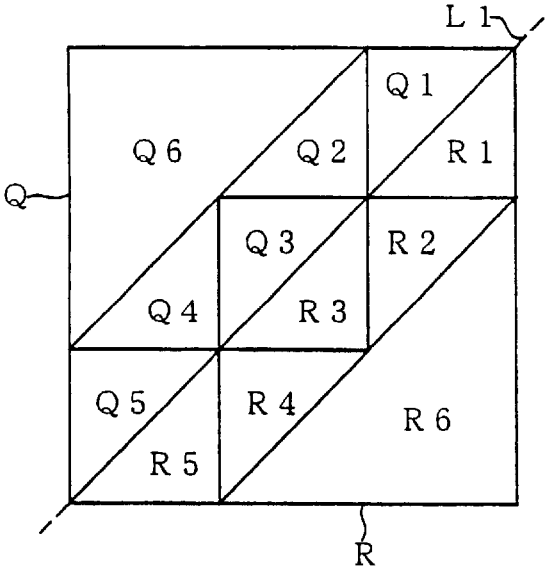
Figure 31D:
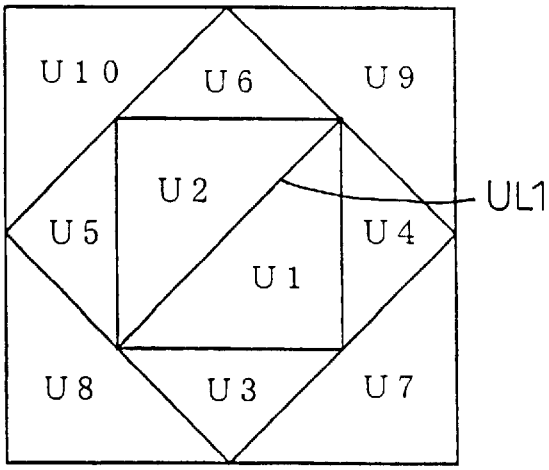
FIG. 31D illustrates a modified quilt design of the quilt design shown in FIG. 31B.
Figure 32A:
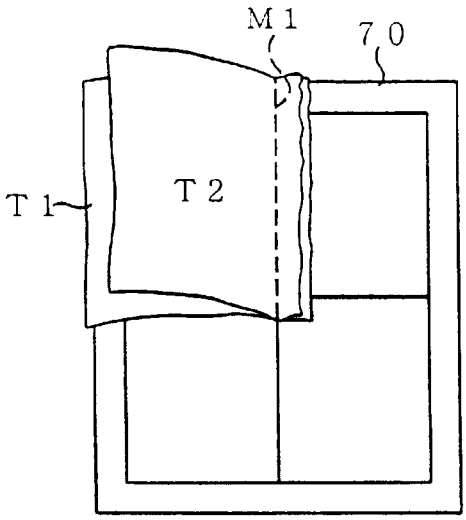
FIGS. 32A through 32D is an example of a quilt design to which the paper piecing is not applicable.
Figure 32B:
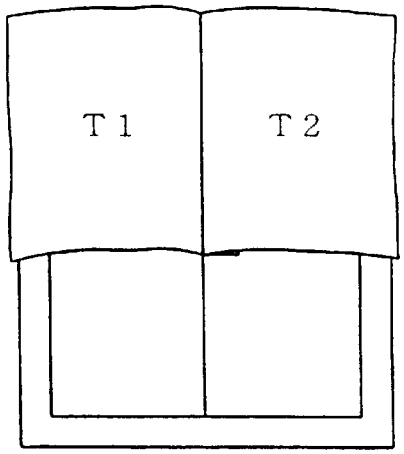
Figure 32C:
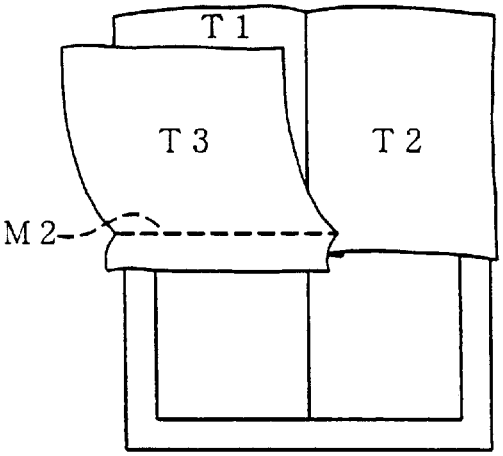
Figure 32D:
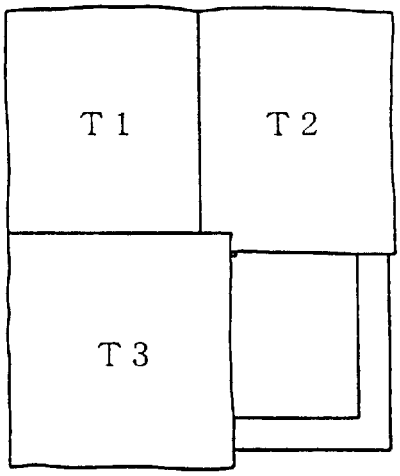

Further, when the CPU 53 detects that a command to modify the inapplicable portion 80 is issued by the operator (S520:Yes) after the CPU 53 displays the inapplicable portion 80 on the CRT display 35 (S510), the CPU 35 sets the displaying condition to be able to perform a modification, that is, the condition that the quilt design can be drawn (S522). For example, the operator deletes the cross lines TL1 and TL2 of the inapplicable portion of the "boxes" shown in FIG. 31B. Then, as shown in FIG. 31D, the operator modifies the quilt design by drawing a diagonal line. By doing so, the quilt design applicable to the paper piecing can be made.

As described above, the quilt design once created can be modified, so that the quilt design which has been drawn with effort cannot be foiled.

Next, the piecing order data generating processing (S600 in FIG. 10) will be described with reference to FIGS. 16, 8A and 8B.

Figure 16:
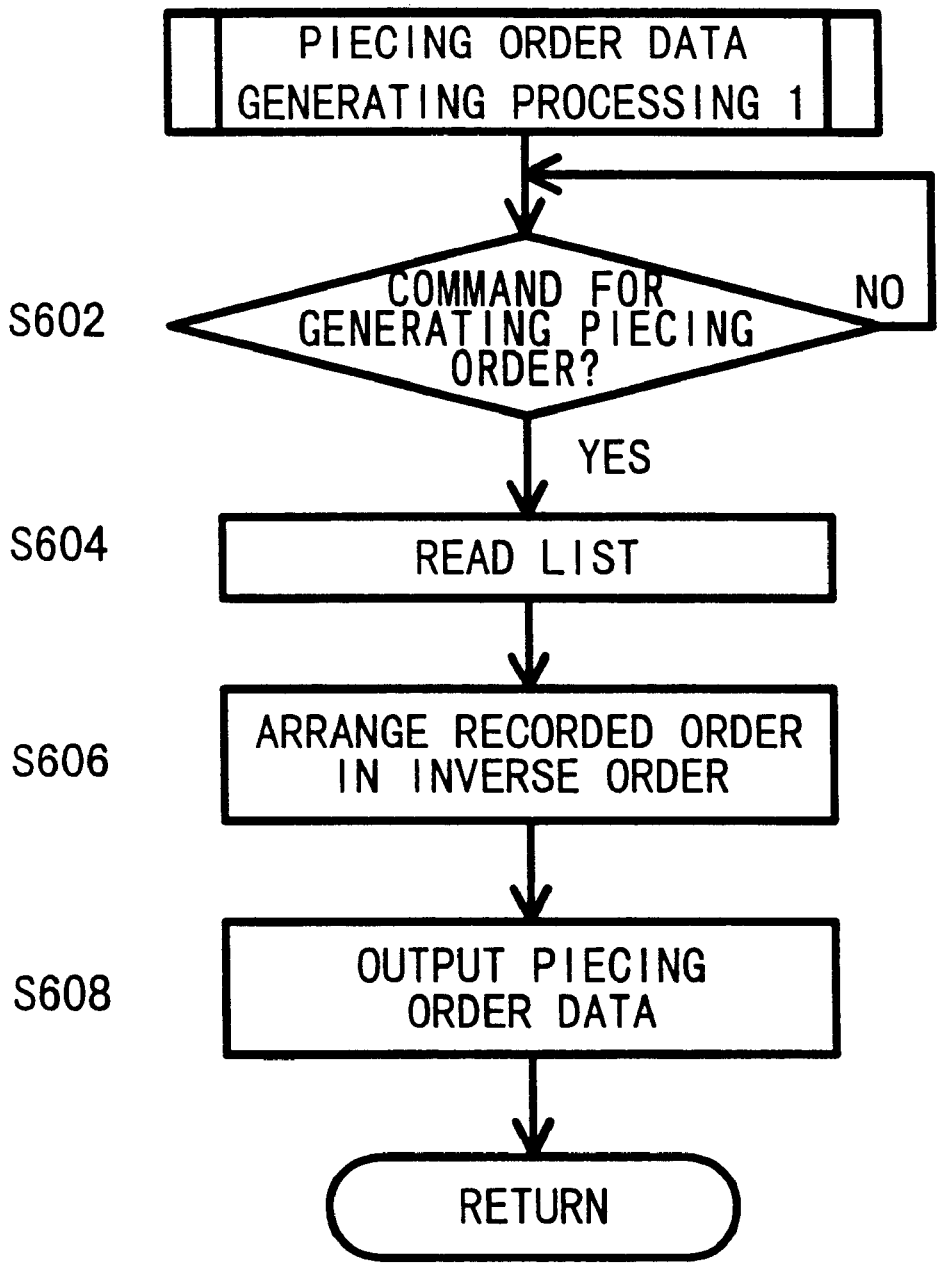
FIG. 16 is a flowchart of piecing order data generating processing 1.

FIG. 16 is a flowchart of the piecing order data generating processing 1. FIG. 8A is a diagram showing a list of separation line data which is the analytical results of the demarcation line analysis processing (S200 in FIG. 10). FIG. 8B is a list of the generated piecing order data.

The CPU 53 detects that a command to generate the piecing order is issued by the operator (S602:Yes), the CPU 53 reads the list storing area 55*e* stored in the RAM 55 (S604). Then, the CPU 53 arranges the recorded order of the separation lines in the list storing area 55*e* in inverse order (S606).

In this embodiment, as shown in FIG. 8A, the separation line data (C, E), (B, F), (A, J, G), and (H, J) are recorded in recorded order 1 through 4, respectively, so that the separation line data (C, E), (B, F), (A, J, G), and (H, J) are arranged in inverse order. Therefore, as shown in FIG. 8B, the separation line data (C, E), (B, F), (A, J, G), and (H, J) are stored in a piecing order data list 55*f* as the piecing order data, with respect to the recorded order 1 through 4.

Then, the CPU 53 outputs the piecing order data list 55*f* made at S606 to the RAM 55 (S608).

Now, the displaying processing that occurs after S512 will be described.

When the CPU 53 detects that the command to generate the piecing order is issued (S512:Yes), the CPU 53 reads the piecing order data list 55*f* stored in the RAM 55, then the CPU 53 makes a piecing order displaying data to display the piecing order on the CRT display 35 based on the piecing order data list 55*f* read from the RAM 55 (S516).

The piecing order displaying data comprises, for example, character data corresponding to the numbers showing the piecing order. For example, parenthesized numbers, circled numbers, or the like, stored in a dictionary in the head disk 58 are used for the character data.

Next, the CPU 53 reads the image data, wherein pieces are separated from the quilt design at S410 in the determining processing 1 (S400) and stored in the RAM 55. Then the CPU 53 brings the read image data into correspondence with the character data made at S524 and displays the image data on the CRT display 35 (S518).

Figure 25E:
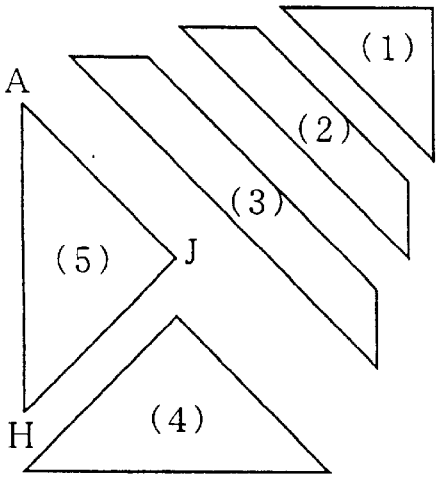
Figure 25F:
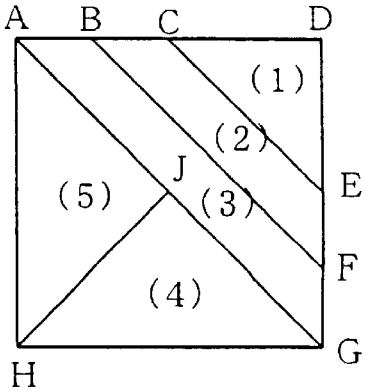

For example, as shown in FIG. 25E, the quilt design is indicated with the parenthesized numbers showing the piecing order corresponding to the each separated piece. Further, as shown in FIG. 25F, the quilt design is indicated with the piecing order corresponding to the each piece before the quilt design is separated into pieces. Furthermore, the quilt design may be indicated with piecing order corresponding to the seam lines.

Figure 17:
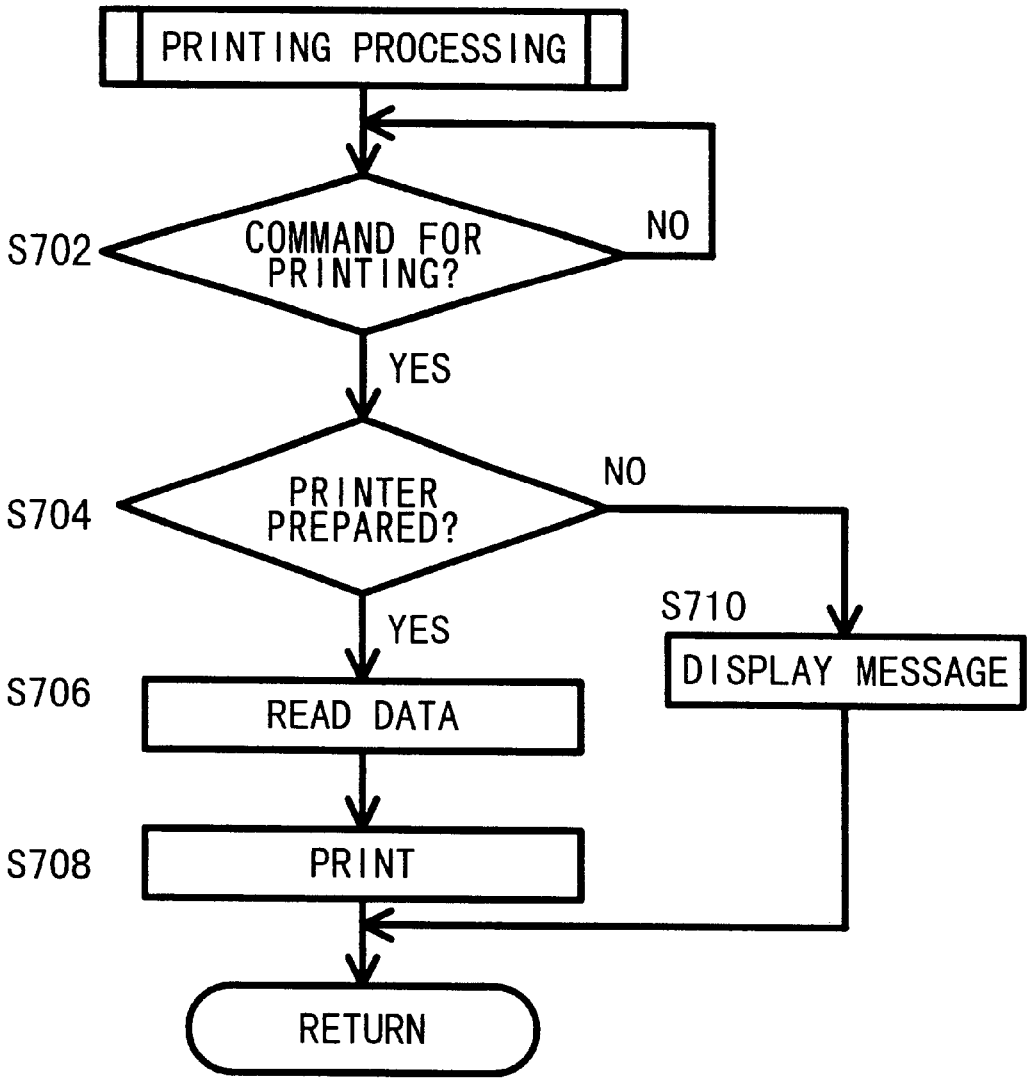
FIG. 17 is a flowchart of printing processing.

Next, the printing processing (S700 in FIG. 10) executed by the CPU 53 will be described with reference to a flowchart in FIG. 17.

When the CPU 53 detects that a command to print is issued by the operator (S702:Yes) and the printer 37 is prepared (S704:Yes), the CPU 53 reads the data stored in the RAM 55 (S706) and prints the read data onto a recording sheet (S708). When the CPU 53 detects that the printer 37 is unprepared (S704:No), a message which informs such a condition of the printer 37 is displayed on the CRT display 35.

In the printing processing, the quilt design drawn by the operator at the design drawing processing (S100), the quilt design displayed on the CRT display 35 at the displaying processing 2, the piecing order (FIGS. 25E and 25F), and the inapplicable portion 80 are the data that prints onto the recording sheet. The quilt design which is stored in the hard disk 58, is read from the RAM card 36, or which is scanned by the color image scanner 33, can also be printed. Further, the determination results displayed on the CRT display 35 at displaying processing 1 can be printed.

Therefore, if the quilt design and the piecing order (FIGS. 25E and 25F) are printed onto the recording sheet for the paper piecing, the printed recording sheet can be used as the foundation. In this case, the piecing order is printed onto the recording sheet, so that it is easy to make a quilt by piecing the pieces according to the piecing order. Therefore, it becomes possible for an inexperienced person to easily make a desirable quilt.

As described above, if the determination device of the first embodiment is used, the own-design quilt can be automatically determined as to whether it is applicable to the paper piecing, using the computer 50.

Therefore, since the quilt design can be determined regardless of an individual's experience or inexperience in the paper piecing, an original quilt can be freely designed.

Further, when the quilt design is determined as being inapplicable to the paper piecing, the inapplicable portion can be displayed in some way. Therefore, the inapplicable design can be referred to in future. Moreover, the inapplicable portion can be modified, so that the quilt design drawn with effort will not be foiled.

In the first embodiment, the quilt design shown in FIG. 24 was used for the example of determination. It goes without saying that the quilt design "fish" shown in FIG. 26 can be determined. The quilt design "fish" can be separated into pieces by the separation order shown in FIG. 27. First, a piece P9 (FIG. 27A) is separated, and then a piece P8 (FIG. 27B), a piece P7 (FIG. 27C), a piece P6 (FIG. 27D), a piece P5 (FIG. 27E), a piece P4 (FIG. 27F), a piece P3 (FIG. 27G), and a piece P2 (FIG. 27H) are separated in this order. Then, the quilt design is separated into pieces.

Therefore, since the quilt design "fish" is separated on a piece-by-piece basis, the quilt design "fish" is determined as being applicable to the paper piecing.

Next, a second embodiment will be described with reference to FIGS. 9A, 18, and 29A through 29K.

Figure 18:
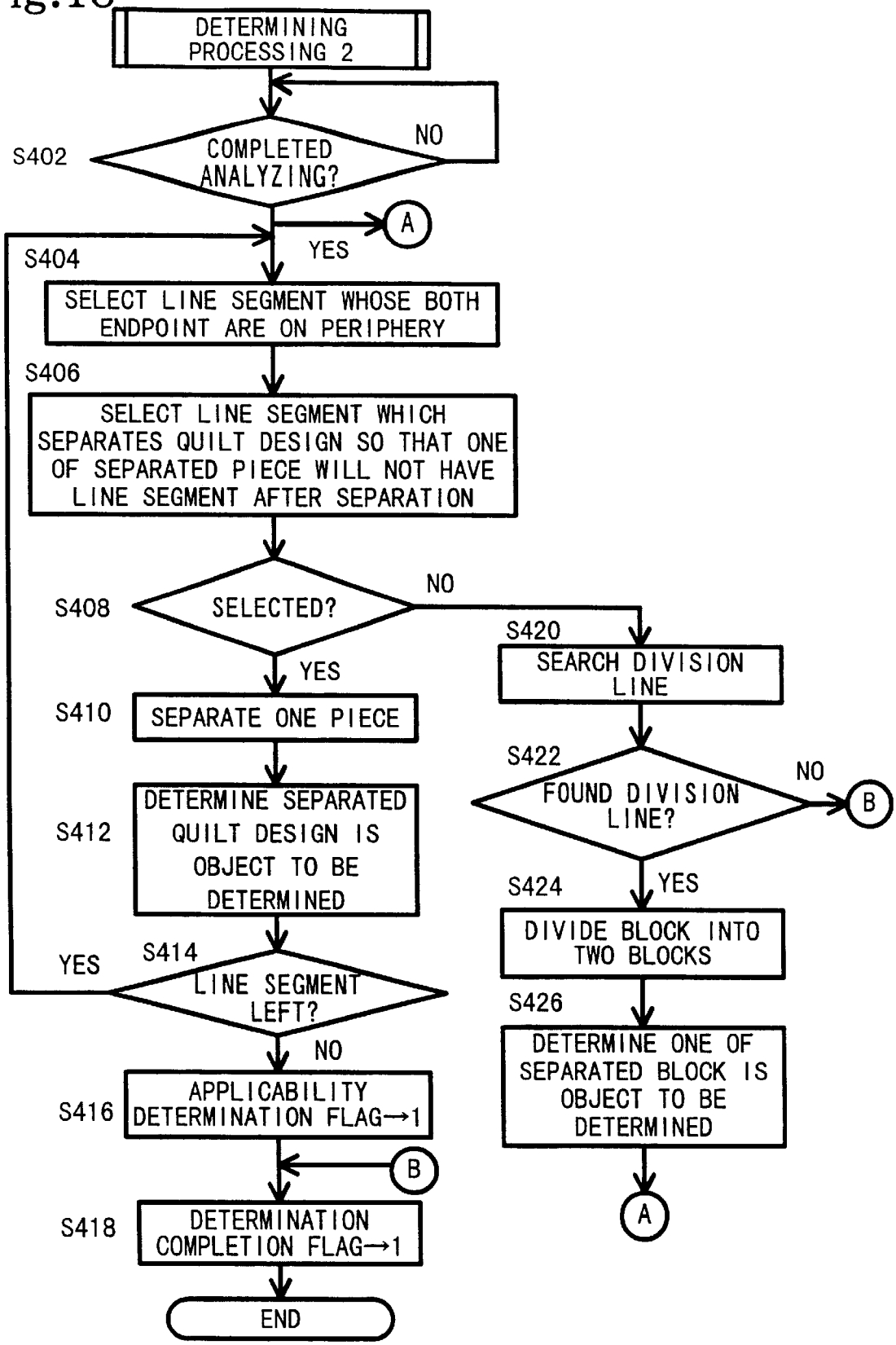
FIG. 18 is a flowchart of determining processing 2.

FIG. 9A is a cutting data list to be stored in the RAM 55. FIG. 18 is a flowchart of a determining processing 2 executed by the CPU 53. FIGS. 29A through 29K illustrate a process of cutting a quilt design to be determined.

A determination device of the second embodiment can determine whether a quilt design, whose all pieces cannot be separated on a piece-by-piece basis, can be separated into pieces if a division into two blocks is included in the cutting steps.

In the second embodiment, the quilt design "NorthWind" is determined as to whether it is applicable to a piecing method in which the separation on a piece-by-piece basis the stitching blocks that includes a plurality of pieces together are included. It is assumed that the demarcation lines have been analyzed by the demarcation line analysis processing (S200) described in the first embodiment and a data list of the analyzed line segments is stored in the RAM 55.

First, a structure of a cutting data list 55*g* will be described with reference to FIG. 9A.

The cutting data list 55*g* includes a cutting type, which shows that a line segment is to be used for the piece separation or the division, a demarcation line, and piece/block to be cut. Each data corresponding to the cutting type, the demarcation line, and the piece/block to be cut will be stored in the cutting data list 55*g* every piece separation or division into two blocks.

Next, a determining processing 2 will be described with reference to the FIG. 18.

When the CPU 53 detects the completion of the demarcation line analysis processing (S200) (S402:Yes), the CPU 53 selects a line segment whose both endpoints are on the periphery (S404), and then selects the line segment, which separates a piece from the quilt design so that the separated piece will not have a line segment to become the separation line, from the selected line segments, after separation (S406). In this embodiment, the line segments BH and DF are selected (see FIG. 26C). At that time, the selected line segments BH and DF are stored in the cutting data list 55*g* in the RAM 55, as shown in FIG. 9A. "Separation" and "P1*b* and P2*b*" are stored in the cutting type and the piece/block to be cut, respectively.

Figure 29A:
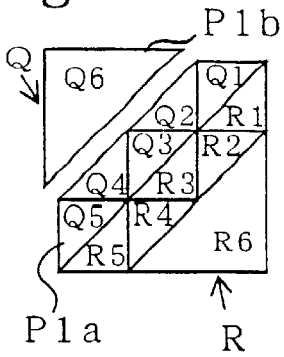
FIGS. 29A through 29K illustrate a process of cutting a quilt design to be determined.
Figure 29B:
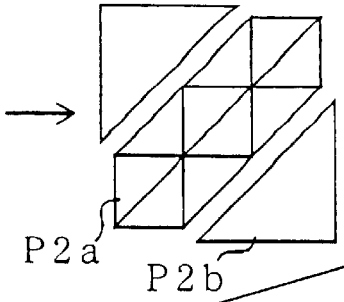

Then, the CPU 53 determines that the selection is completed (S408:Yes), and separates a piece at the selected line segment (S410). In this embodiment, as shown in FIG. 29A, a piece Q6 is separated at the line segment BH. Next, the CPU 53 determines that a block P1*a* is the object to be determined, after separation (S412), and determines that there are line segments in the line segment list (S414:Yes). Then, the CPU 53 selects the line segment DF (S404 and S406), as shown in FIG. 29B, the CPU 53 separates a piece R6 at the line segment DF (S408:Yes, and S410).

Next, the CPU 53 determines that a block P2*a* is the object to be determined, after separation (S412), and selects line segments BJK, ILF, IJD, and HLK (S404).

Figure 26C:
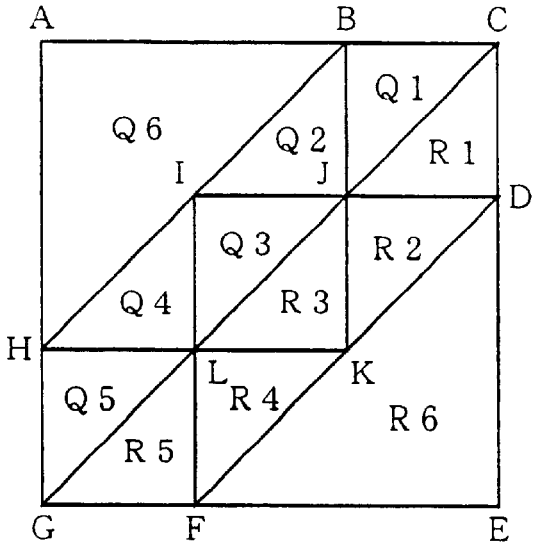
Figure 27A:
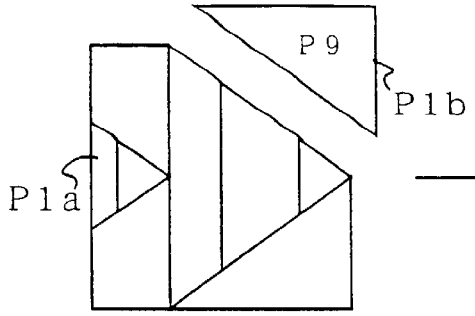
FIGS. 27A through 27H illustrate a separating order of a quilt design "fish" on a piece-by-piece basis.
Figure 27B:
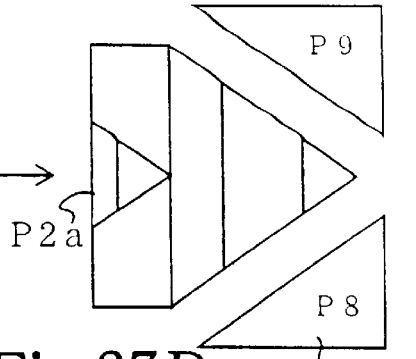
Figure 27C:
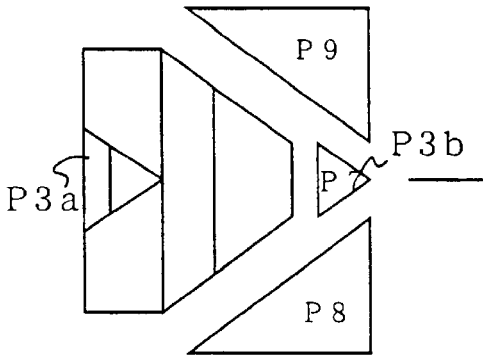
Figure 27D:
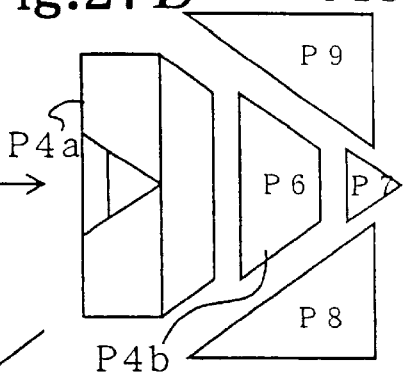
Figure 27E:
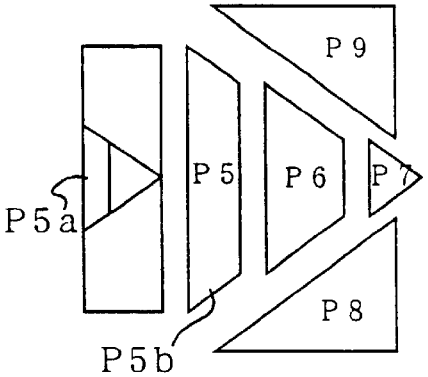
Figure 27F:
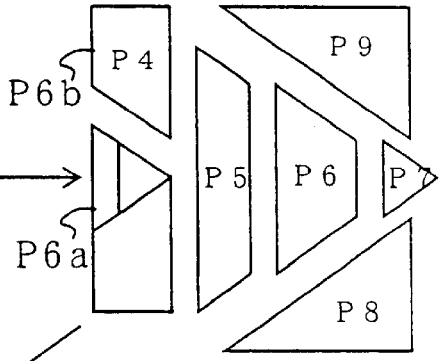
Figure 27G:
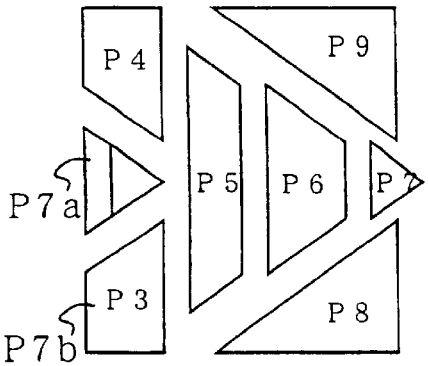
Figure 27H:
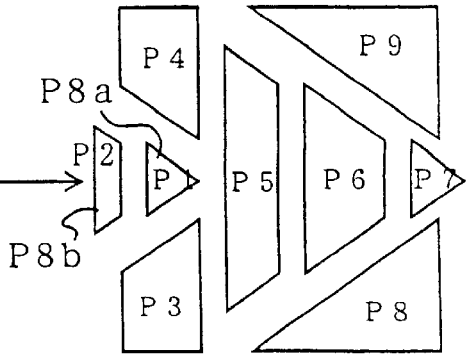
Figure 29C:
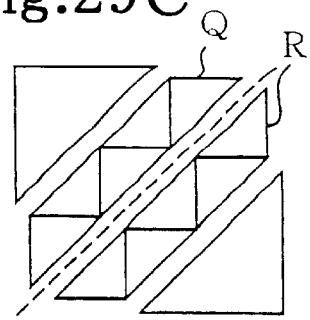
Figure 29D:
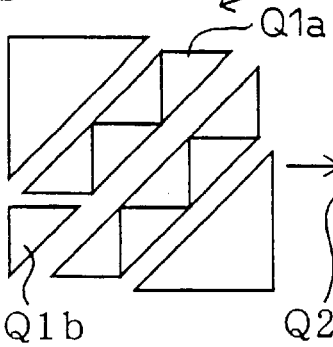
Figure 29E:
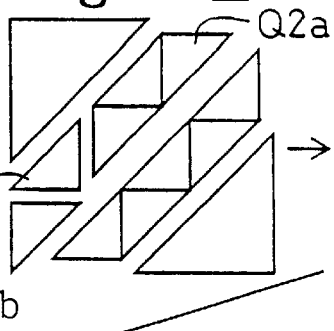
Figure 29F:
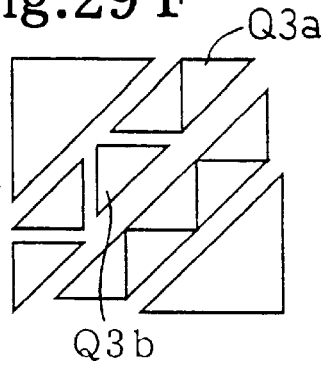
Figure 29G:
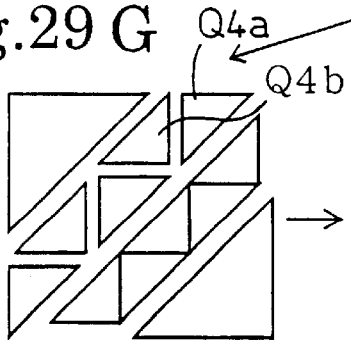
Figure 29H:
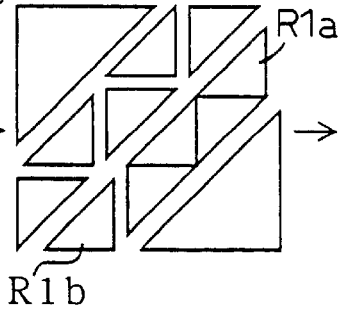
Figure 29I:
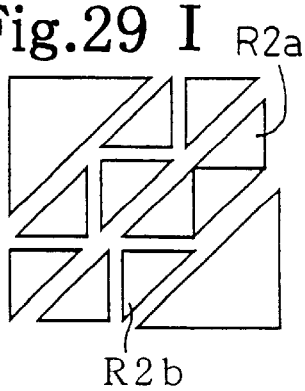
Figure 29J:
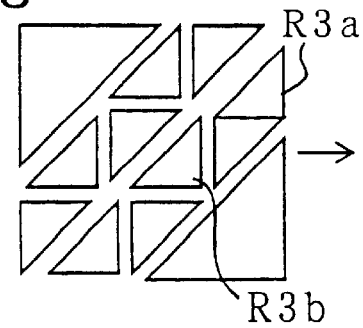

If the block P2*a* is separated at the selected line segments, as shown in FIG. 26C, the other line segments will be left in the both blocks after separation, so that, at S406, the CPU 53 determines that line segments cannot be selected (S408:No), and searches a line segment (hereinafter referred to as a division line) which divides the block P2*a* into two blocks (S420). In this embodiment, as shown in FIG. 26C, the division line CG will be detected, so that the CPU 53 determines that there is a division line (S422:Yes), and as shown in FIG. 29C, the CPU 53 divides the block P2*a* into two blocks (S424). Then, the CPU 53 determines that one of the divided blocks is the object to be determined (S426). In this embodiment, of blocks Q and R, the block Q is to be determined.

From then on, the CPU 53 executes S404 through S414 on the block Q and separates pieces on a piece-by-piece basis (FIGS. 29D through 29G). The data corresponding to the line segment, the cutting type, and the piece/block to be cut will be stored in the cutting data list 55*g* (FIG. 9A). For the block R, the same processing performed on the block Q is performed thereon, and the CPU 53 separates pieces on a piece-by-piece basis (FIGS. 29H through 29K). The data corresponding to the line segment, the cutting type, and the piece/block to be cut will also be stored in the cutting data list 55*g* (FIG. 9A).

Figure 29K:
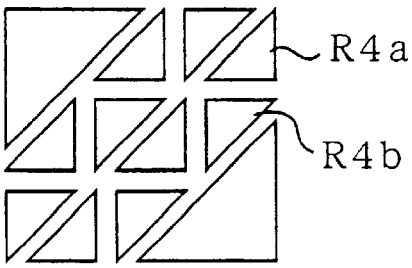
Figure 30A:
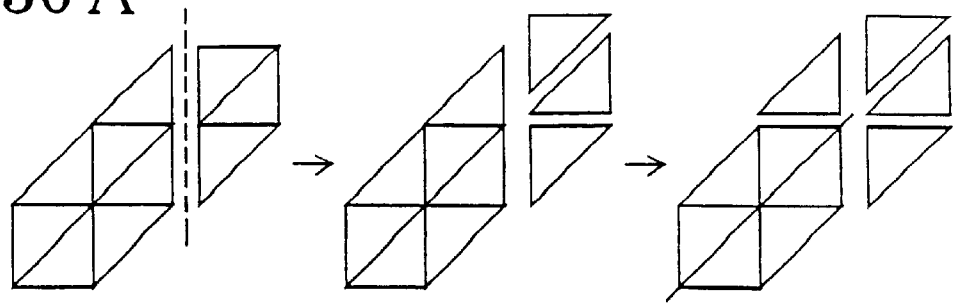
FIGS. 30A through 30E illustrate division patterns of a block portion of the quilt design "NorthWind"
Figure 30B:
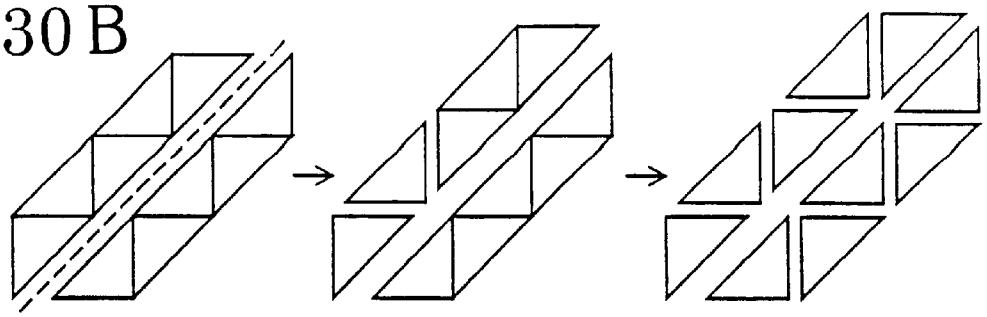
Figure 30C:
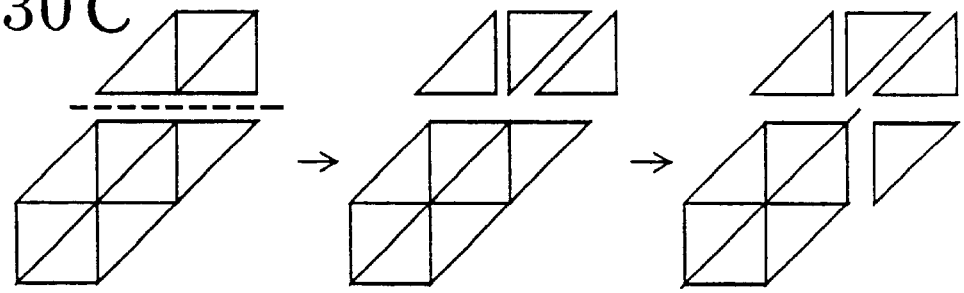
Figure 30D:
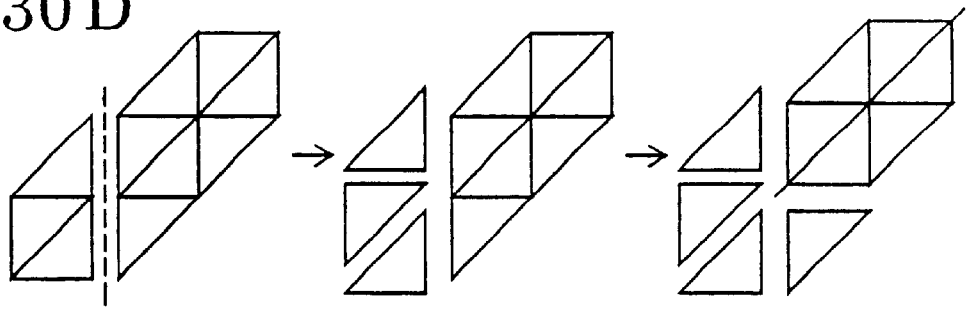
Figure 30E:
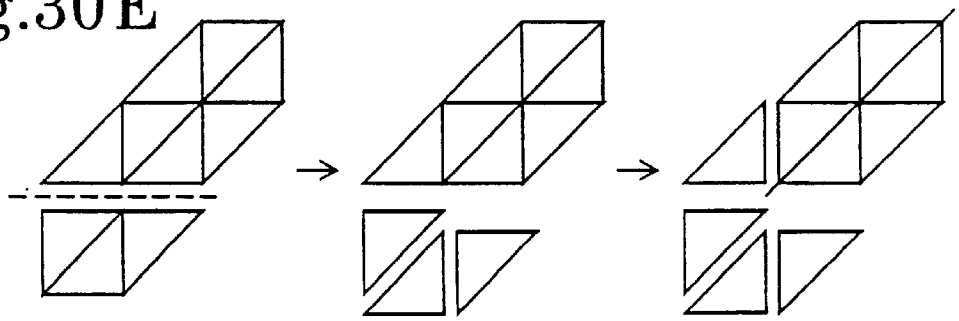

As shown in FIG. 29K, when all pieces are separated, the CPU 53 determines that there is no line segment left (S414:Yes). Therefore, the CPU 53 sets the applicability determination flag (S416) and the determination completion flag (S418), and completes the determining processing 2.

Figure 15:
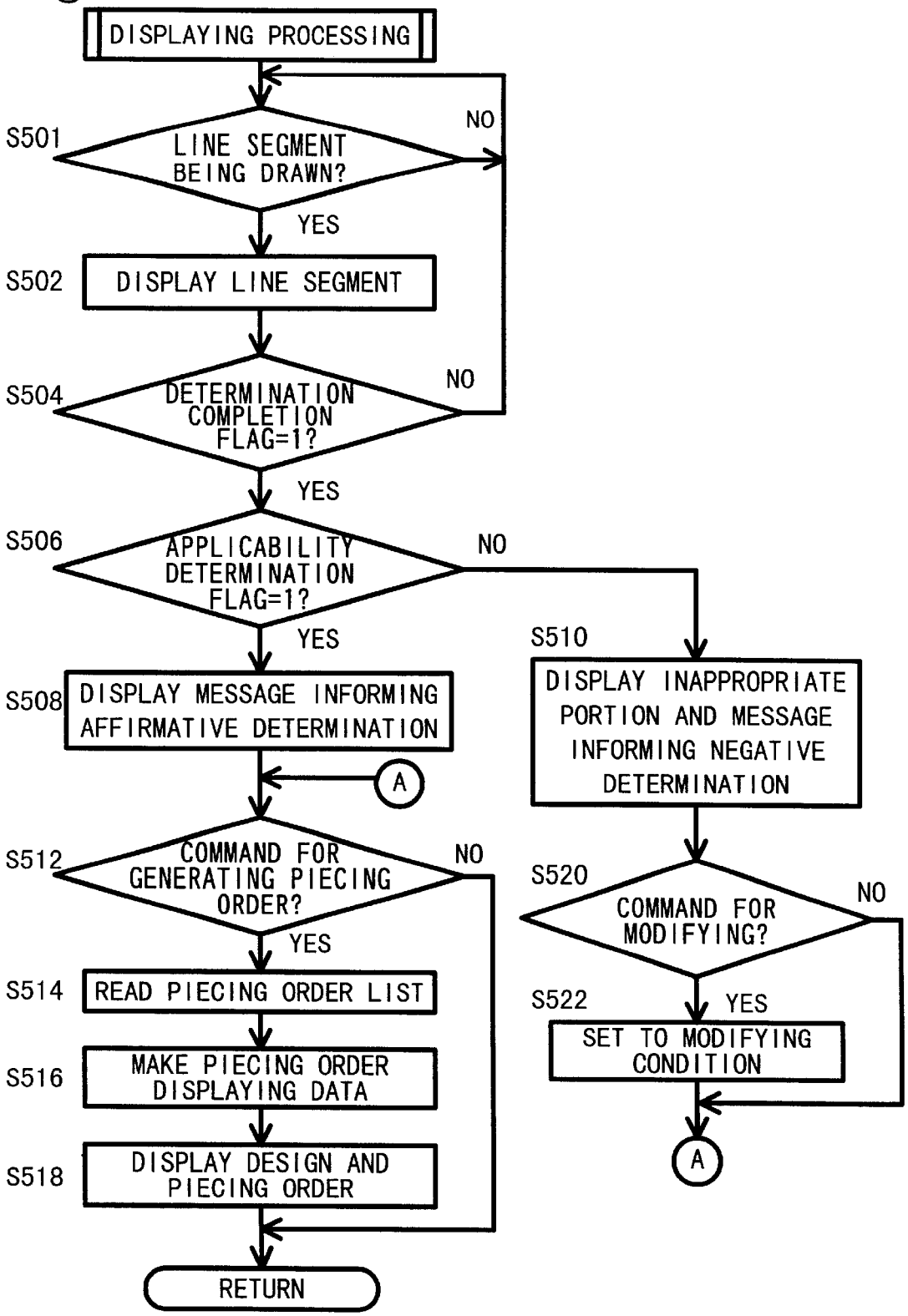
FIG. 15 is a flowchart of displaying processing.

Then, the determination results are displayed on the CRT display 35 by the displaying processing (FIG. 15). Further, the piecing order can be displayed on the CRT display 35 with the pieces by the operator, and can be printed onto a paper using the printer 37.

As described above, if the determination device of the second embodiment is used, the quilt design can be automatically determined as to whether it is applicable to the paper piecing, though all pieces of the quilt design cannot be separated into pieces only on a piece-by-piece basis, but it becomes possible to be separated on a piece-by-piece basis if the quilt design is divided into two blocks.

Next, a third embodiment will be described with reference to FIGS. 19 through 21 and 30A through 30E.

By the way, the paper piecing features that a desirable quilt can be made by only stitching one side of a piece with straight stitches using a sewing machine, so that it is preferable that the number of stitching blocks together is low as possible.

Thus, if a determination device of the third embodiment is used, the most applicable division pattern for the paper piecing can be selected when a plurality of division patterns are available.

Figure 19:
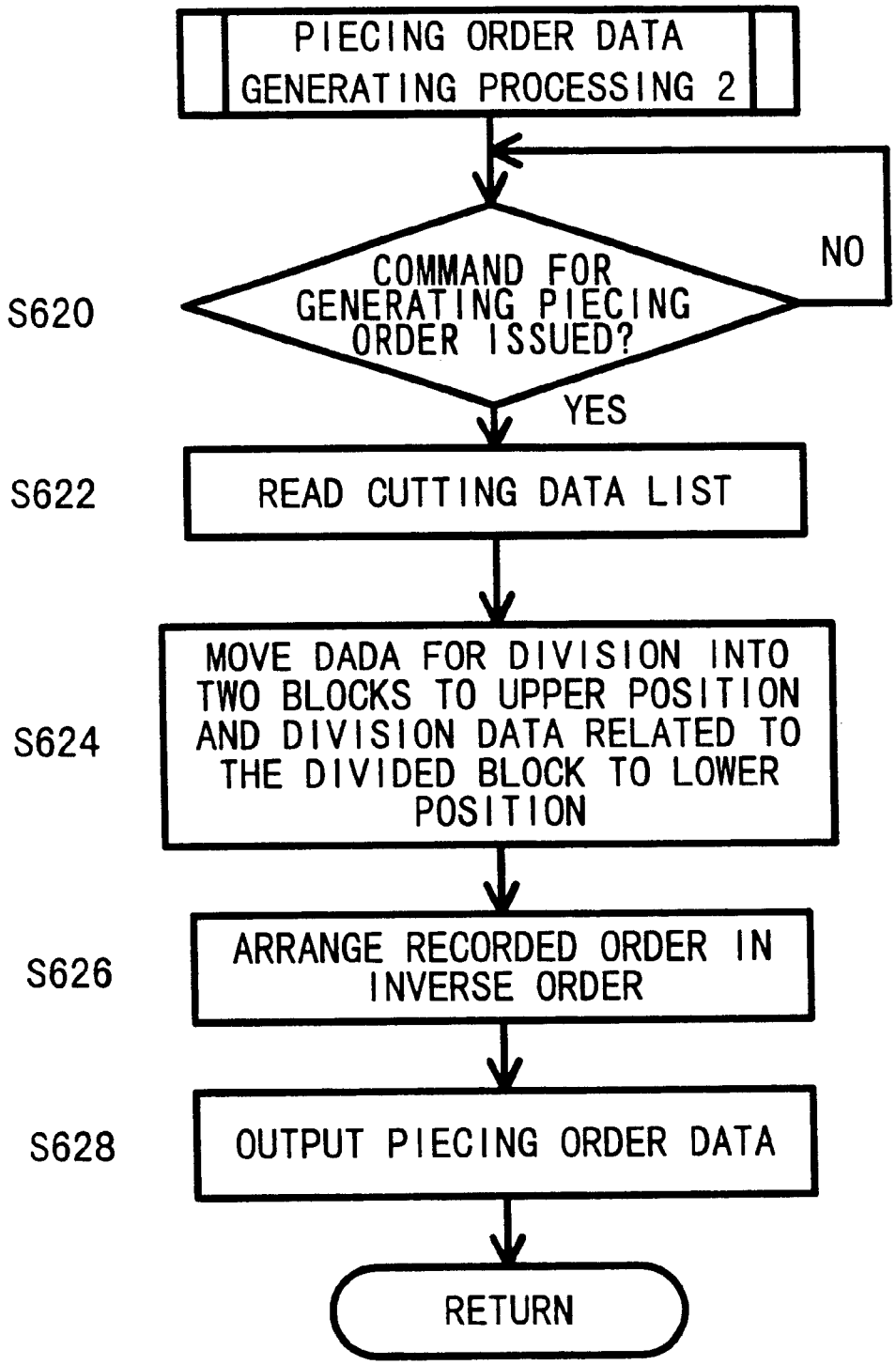
FIG. 19 is a flowchart of piecing order data generating processing 2.
Figure 20:
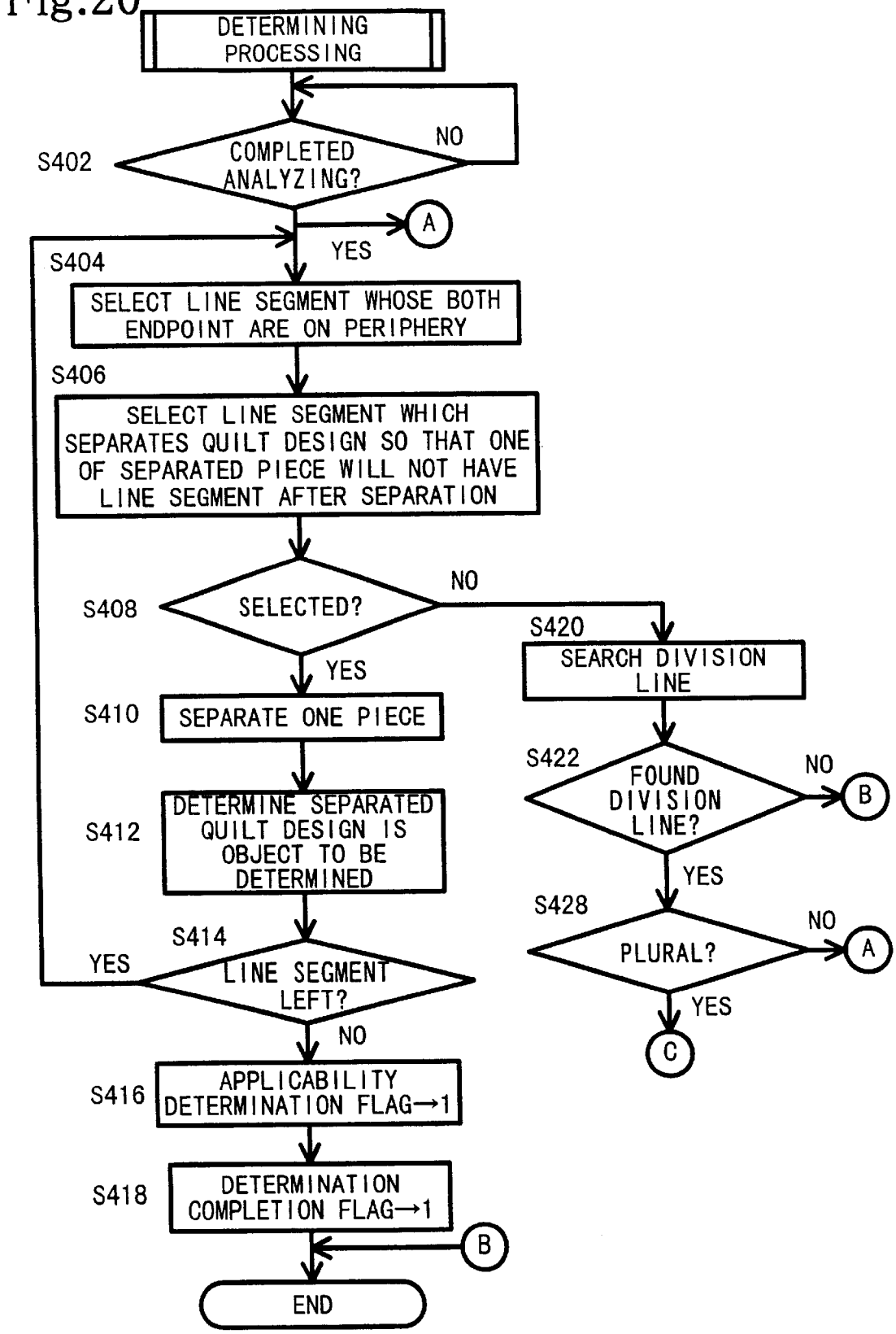
FIG. 20 is a flowchart of determining processing 3.
Figure 21:
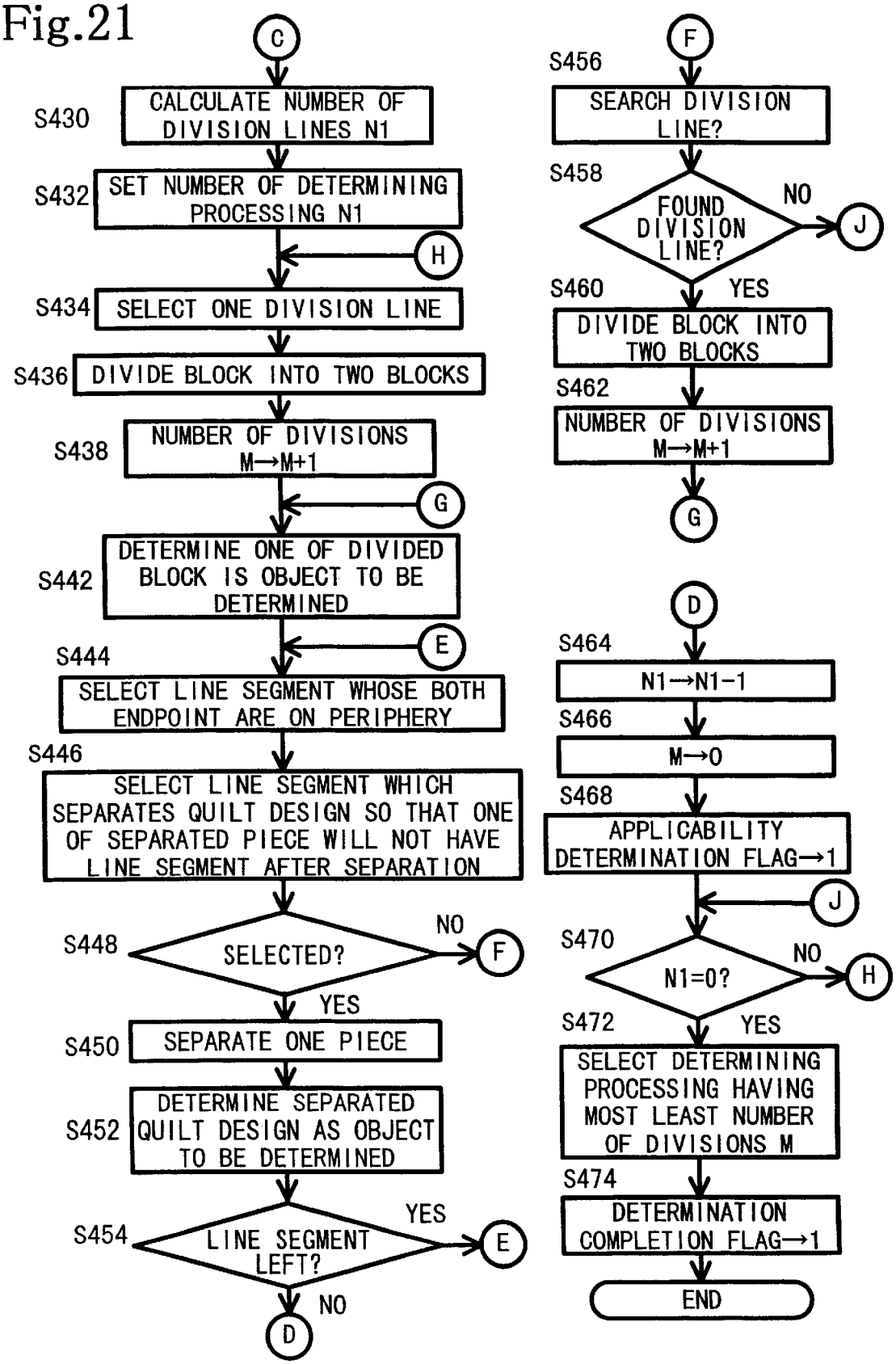
FIG. 21 is a flowchart of determining processing 3 following the determining processing 3 of FIG. 20.

FIG. 19 is a flowchart of a piecing order data generating processing 2 in the third embodiment. FIGS. 20 and 21 are flowcharts of determining processing 3. FIGS. 30A through 30E show division patterns for the block P2*a* of the quit design "NorthWind".

In this embodiment, the quilt design "NorthWind" (FIG. 31C) is determined. It is assumed that a demarcation line analysis processing for the quilt design "NorthWind" is completed by the same way as the first embodiment. Further, S402 through S422 of the determining processing 3 shown in FIG. 20 are the same processing as the determining processing 2 in the second embodiment, so that different processing will be mainly described hereinafter.

As shown in FIG. 29, when the big triangular pieces Q6 and R6 in the quilt design "NorthWind" are separated, a block P2*a*, where a plurality of small triangular pieces are gathered, remains.

As shown in FIGS. 30A through 30E, there are five patterns that divide the block P2*a* into two blocks. L1 and L2 in the figures are the division lines. The pattern having less division lines is applicable to the paper piecing, so that the CPU 53 executes a processing to select such a pattern.

In the processing described below, the data related to the separated pieces and the divided blocks will be stored in the cutting data list 55*g* every determining processing, as shown in FIG. 9A.

When the CPU 53 determines that the division line exists (S422:Yes), the CPU 53 determines whether there are a plurality of division lines, that is, there are a plurality of patterns that divide the block P2*a* into two blocks(S428). In this embodiment, as shown in FIGS. 30A through 30E, there are five division lines, so that the CPU 53 determines affirmatively (S428:Yes) and goes to S430 in FIG. 21.

Then, the CPU 53 calculates a number of the division lines N1 (S430). In this embodiment, the number of division lines N1=5. Next, the CPU 53 sets the number of performing the determining processing 3 to the same number as that of the division lines N1 (S432). That is, the determining processing 3 is performed a number of times that equals the number of the division lines.

Next, the CPU 53 selects one division line from the division lines (S434), and divides the block P2*a* into two blocks at selected division line (S436). Then, the CPU 53 adds 1 to a number of divisions M (S438), and determines that one of the divided blocks is the object to be determined (S442). After that, the CPU 53 executes the separation on a piece-by-piece basis by executing the same processing as S404 through S414 shown in FIG. 20 (S444 through S454). Then, the CPU 53 repeats S444 through S454 until the CPU 53 determines that there are no line segments, which can separate a piece from the quilt design (S448:No). When the CPU 53 determines that the line segment cannot be selected (S448:No), the CPU 53 searches the other division line (S456).

When the CPU 53 determines that there is another division line (S458:Yes), the CPU 53 divides the block into two blocks (S460) and adds 1 to the number of divisions M (S462). Then, the CPU 53 determines that the one of the divided blocks is the object to be determined (S442), and separates pieces from the block (S444 thorough S454).

As described above, the CPU 53 repeats S444 through S472. When the CPU 53 determines that there is no line segment to be division line (S454:No), the CPU 53 subtracts 1 from a number of determining processing N1 (S464). That is, the determining processing 3 for the division line selected at S434 is completed. Then the CPU 53 resets the number of divisions M for the next determining processing 3 (S466), and sets the applicability determination flag (S460).

Next, the CPU 53 determines whether the number of determining processing N1 becomes 0 (S470). When the number of determining processing N1 is not 0 (S470:No), the CPU 53 selects the next division line (S434) and executes the same processing described above (S436 through S470).

After the CPU 53 completes the determining processing 3 for all selected division lines (S470: Yes), the CPU 53 selects the determining processing having the lowest number of divisions M (S472), and sets the determination completion flag (S474).

If the piecing order data is generated based on the cutting data list 55*g* corresponding to the selected determining processing, the quilt can be made with the lowest number of divisions M, that is, with the lowest number of joining the blocks together.

As described above, if the determination device of the third embodiment is used, the piecing pattern having the lowest number of joining the blocks together can be selected even when the quilt design has a plurality of division patterns of block.

Therefore, regardless of an individual's experience or inexperience in making a quilt, the quilt can be made efficiently.

Figure 22:
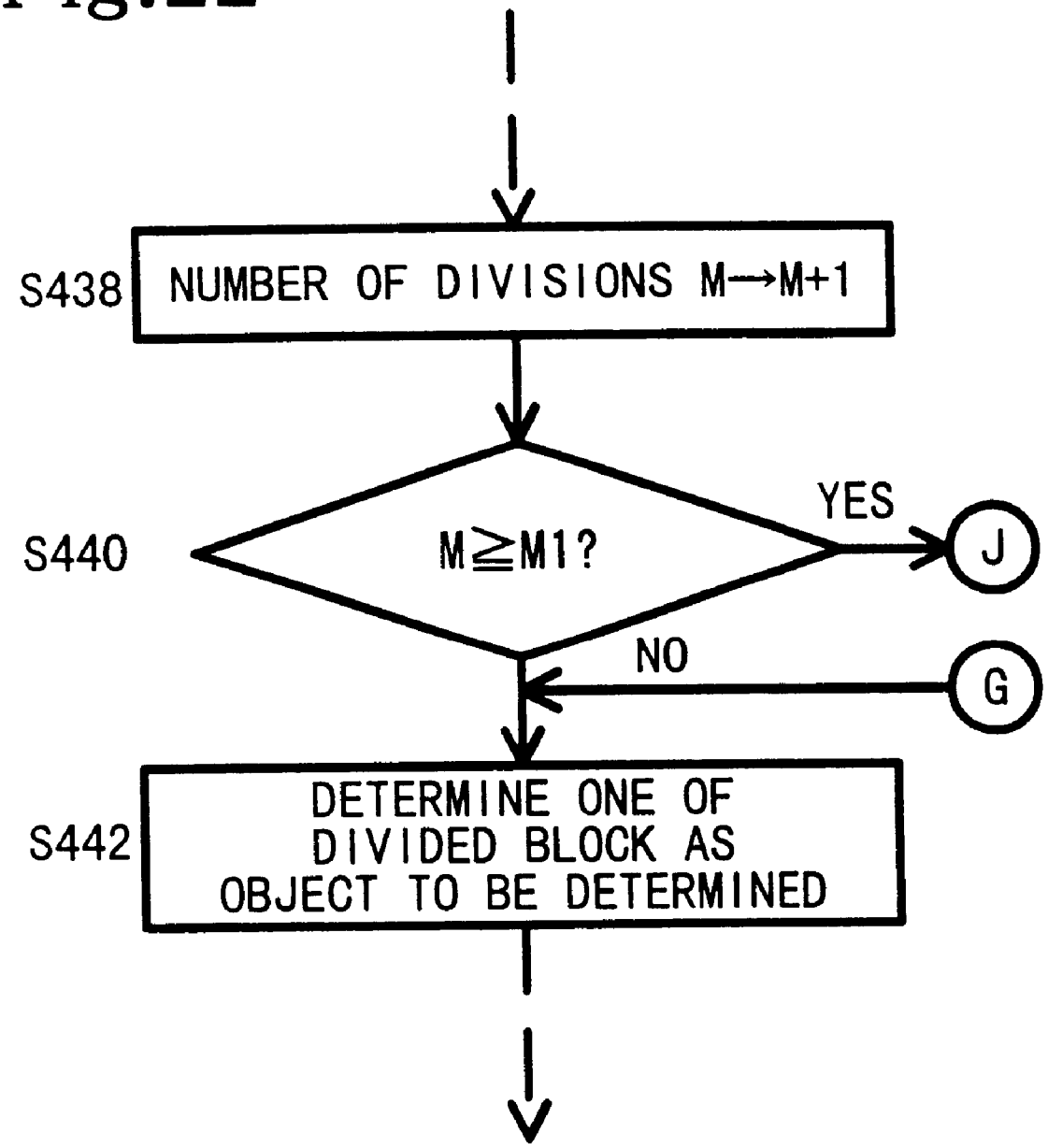
FIG. 22 is a part of the flowchart of the determining processing 3.

When the number of divisions M becomes a certain number or more, the determination device can be so structured to indicate the determination results, which the quilt design is not applicable to the paper piecing, at an early stage. For example, the determining processing of this case is shown in FIG. 22. FIG. 22 is a flowchart of a part of the determining processing 3.

In short, the CPU 53 determines whether the number of divisions M is equal to or greater than a predetermined number of divisions M1 (S440) after the processing that CPU 53 adds 1 to the number of divisions M (S438). When the number of divisions M is equal to or greater that the predetermined number of divisions M1, the CPU 53 goes to S470 shown in FIG. 21 (S440:Yes). In this case, the applicability determination flag is not set (S468), so that the determination of applicability is not performed.

Figure 23:
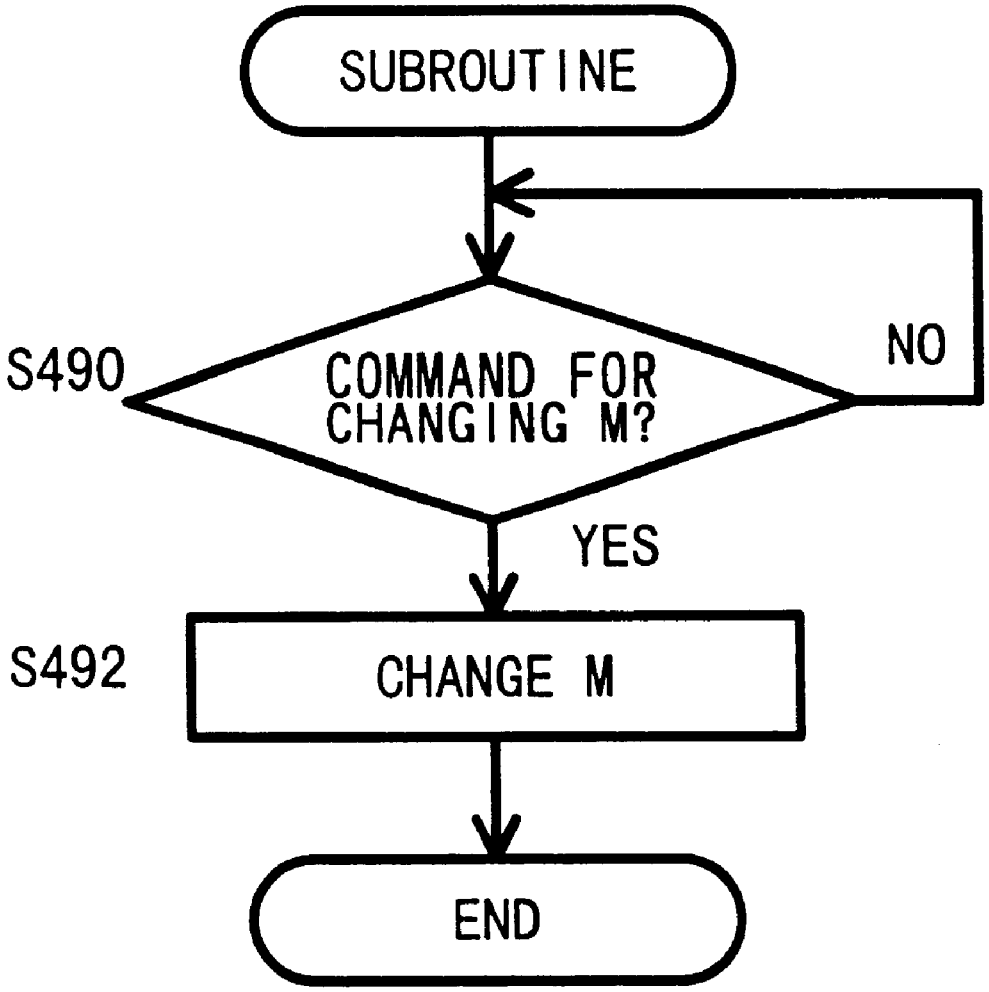
FIG. 23 is a flowchart of a processing when changing the number of divisions M.

Further, the determination device 30 can be so structured that the number of divisions M can be changed. A processing of this case is shown in a flowchart of FIG. 23.

In short, a subroutine is provided in the processing. When the CPU 53 detects that a command to change the number of divisions M is issued by the operator (S490:Yes), the CPU 53 changes the number of divisions M (S492).

As described above, the determination device 30 is so structured that the number of divisions M can be changed to a desirable number. Therefore, the number of joining the blocks together can be suit to the experience of making the quilt or the structure of the quilt design.

Further, the determination device 30 can be so structured that the piecing order of the joint of the blocks is postponed to the piecing order of piecing one piece, as far as possible.

FIG. 19 is a flowchart of the piecing order data generating processing 2 of this case.

When the CPU 53 detects that a command for generating the piecing order is issued (S620:Yes), the CPU 53 reads the cutting data list 55*g* shown in FIG. 9A (S622). Then the CPU 53, as shown in FIG. 9B, arranges the data so that the data "division" in the read cutting data list 55*g* is moved to an upper position, and the division data corresponding to the divided block is moved to a lower position (S624). Then, the CPU 53 makes the piecing order data by arranging the recorded order in inverse order (S626), and outputs the piecing order data (S628).

As described above, the determination device 30 can be so structured that the piecing order of the joint of the blocks is postponed to the piecing order of piecing one piece, as far as possible, so that the piecing order suitable for the paper piecing can be obtained.

In the each embodiment, the paper piecing has been described as the piecing method to be determined, for example. Further, this invention can be applied to other piecing methods.

In the each embodiment, as shown in FIG. 1, mainly the computer 50 acts as the determination device of the invention. Further, the determination device can be a stand alone device, or can be combined in a sewing machine.

Further, in each embodiment, the case which the determination for the quilt design drawn by the operator has been described for example. Further, the quilt design read by the color image scanner 33 can be determined. In this case, the read image data is changed to vector, and an image forming program that calculates coordinates of endpoints of each line segment is used based on the vectorized image data.

Furthermore, the quilt design supplied from the RAM card 36 can be determined.

The programs used in the each embodiment are stored in the CD-ROM 65, the floppy disk 64, or the RAM card 36. The CPU 53 can be made to execute these programs by installing the programs into the hard disk 58 or the RAM 55. The programs can also be stored in the hard disk 58 or the ROM 54 in advance.

What is claimed is:

1. An applicability determination device for quilt design, comprising:

an analyzer that analyzes a quilt design, based on quilt data showing the quilt design that includes a plurality of pieces; and a determiner that determines whether the quilt design is applicable to a predetermined piecing method for making a quilt, based on results analyzed by the analyzer.

2. The applicability determination device for quilt design according to claim 1, wherein the analyzer extracts a demarcation line as a separation line from demarcation lines demarcating adjacent pieces based on a property of the demarcation line, and the determiner comprises a piece separator that separates a piece from the quilt design at the demarcation line extracted as the separation line by the analyzer, and a piece separation determiner that determines whether all of the plurality of pieces can be separated by repeating the separation by the piece separator, the determiner determining whether the quilt design is applicable to the predetermined piecing method that makes a quilt by stitching pieces on a piece-by-piece basis, based on the determination by the piece separation determiner.

3. The applicability determination device for quilt design according to claim 2, further comprising:

a separation line data memory that stores separation line data showing the separation line to be used when the piece separator separates a piece; and a piecing order data generator that generates data on a piecing order of each piece, based on an inverse order of a storing order of the separation line data stored in the separation line data memory, and the separation line data corresponding to the piecing order.

4. The applicability determination device for quilt design according to claim 2, wherein the determiner comprises a divider that divides the design into two blocks that include a plurality of pieces at the demarcation line regarded as a division line based on the property of the demarcation line analyzed by the analyzer, and the piece separation determiner determines whether all pieces can be separated by a combination of the division into two blocks achieved by divider and the separation achieved by the piece separator on a piece-by-piece basis, wherein the determiner determines whether the design is applicable to a piecing method for making a quilt by the combination of the division into two blocks achieved by divider and the separation achieved by the piece separator on a piece-by-piece basis, based on the results determined by the piece separation determiner.

5. The applicability determination device according to claim 4, further comprising:

a cutting data memory that stores the separation line data showing the separation lines to be used when the piece separator achieves the piece separation and the division line data showing the division lines to be used when the divider achieves the division into two blocks, in order; and a piecing order generator that generates data on the piecing order of each piece by associating the piecing order that is the inverse of the separation stored in the cutting data memory with the separation line data and the division line data corresponding the piecing order under a predetermined rule.

6. The applicability determination device for quilt design according to claim 5, wherein the predetermined rule is to set a number of joint of the blocks that include a plurality of pieces to be the lowest number.

7. The applicability determination device for quilt design according to claim 6, wherein the predetermined rule is that the piecing order of the joint of the blocks that include a plurality of pieces is postponed to the piecing order of piecing one piece, as far as possible.

8. The applicability determination device for quilt design according to claim 5, wherein the determiner cuts the design in a plurality of cutting steps using the separator and the divider, the cutting data memory stores the separation line data showing the separation line to be used when the piece separator achieves the piece separation and the division line data showing the division lines to be used when the divider achieves the division into two blocks, in order every cutting step, and the piecing order generator seeks data on the piecing order of each piece every cutting step, based on the piecing order that is the inverse of recording order of the separation line data and the division line data stored in the cutting data memory and the separation data and the division data corresponding to the piecing order, selects the data meeting a predetermined criteria from the data on the obtained piecing order, and generates data as the selected piecing order data.

9. The applicability determination device for quilt design according to claim 4, wherein the divider divides the design into two blocks when the piece separation determiner determines that all pieces cannot be separated into pieces by the piece separator on a piece-by-piece basis.

10. The applicability determination device for quilt design according to claim 9, wherein the piece separation determiner determines that the design is not applicable to the piecing method for making a quilt by the combination of stitching a piece and the joining two blocks when the number of divisions performed by the divider exceeds a predetermined number.

11. The applicability determination device for quilt design according to claim 10, further comprising:

a division number setting changer that changes a setting of the predetermined number of divisions.

12. The applicability determination device for quilt design according to claim 2, wherein the property of the demarcation line shows whether the demarcation line is a line segment whose both endpoints are on a periphery of the design, and whether the separation line is a line segment whose both endpoints are on the periphery of the design to be separated.

13. The applicability determination device for quilt design according to claim 4, wherein the property of the demarcation line shows whether the demarcation line is a line segment whose both endpoints are on a periphery of the design, and whether the division line is a line segment whose both endpoints are on the periphery of the design to be divided into two.

14. The applicability determination device for quilt design according to claim 2, further comprising:

a determination result informer that indicates results determined by the determiner.

15. The applicability determination device for quilt design according to claim 14, wherein the determination result informer displays the determination results of the determiner on a screen.

16. The applicability determination device for quilt design according to claim 2, further comprising:

a design display displaying the design on the screen.

17. The applicability determination device for quilt design according to claim 3, wherein the data on the piecing order is data that the piecing order is brought into correspondence with separation lines, the applicability determination device further comprising:

a piecing order display that displays a piece separated at the separation line and the piecing order that corresponds, on the screen.

18. The applicability determination device for quilt design according to claim 5, wherein the data on the piecing order is data that the separation lines or the division lines are corresponded with the piecing order, the applicability determination device further comprising:

a piecing order display that displays a piece separated at the separation line and a block divided at the division line and the piecing order that corresponds, on the screen.

19. The applicability determination device for quilt design according to claim 17, wherein the piecing order display displays the separation line as a seam line and the piecing order that corresponds, on the screen.

20. The applicability determination device for quilt design according to claim 15, further comprising:

an inapplicable portion display that displays at least an inapplicable portion of a design when the determiner determines that the design is not applicable to the predetermined piecing method.

21. The applicability determination device for quilt design according to claim 20, further comprising:

a modifier that modifies the design displayed on the screen.

22. The applicability determination device for quilt design according to claim 17, wherein the piecing order display displays the piecing order in color.

23. The applicability determination device for quilt design according to claim 19, wherein the piecing order display displays the pieces which are identical in shape, in the same color.

24. The applicability determination device for quilt design according to claim 2, further comprising:

a memory that stores the quilt data.

25. The applicability determination device for quilt design according to claim 2, wherein the predetermined piecing method is a paper piecing such that the pieces are stitched on a foundation.

26. The applicability determination device for quilt design according to claim 14, further comprising:

a determination result printer that prints the determination results on a recording medium.

27. The applicability determination device for quilt design according to claim 2, further comprising:

a design printer that prints the design on the recording medium.

28. The applicability determination device for quilt design according to claim 17, further comprising:

a piecing order printer that prints contents that can be displayed by the piecing order display on the recording medium.

29. The applicability determination device for quilt design according to claim 2, further comprising:

an inapplicable portion printer that prints at least the inapplicable portion of the design on the recording medium when the design is determined as being inapplicable to the predetermined piecing method by the determiner.

30. A memory medium storing an applicability determination program to be executed by a computer to perform an applicability determination, comprising:

an analyzing program for analyzing a quilt design based on quilt data showing the quilt design that includes a plurality of pieces; and a determination program for determining whether the quilt design is applicable to a predetermined piecing method for making a quilt, based on results analyzed by the analyzing program.

31. The memory medium according to claim 30, wherein the analyzing program extracts a demarcation line as a separation line from demarcation lines demarcating adjacent pieces based on a property of the demarcation, and the determination program comprises a piece separation program for separating a piece from the quilt design at the demarcation line extracted as the separation line by the analyzing program and a piece separation determination program for determining whether all of the plurality of pieces can be separated by repeating executing the piece separation program, the determination program determining whether the quilt design is applicable to the predetermined piecing method that makes a quilt by stitching pieces on a piece-by-piece basis.

* * * * *